United States Patent [19]

Ikenoue et al.

[11] 4,258,129

[45] Mar. 24, 1981

[54] THERMALLY DEVELOPABLE LIGHT SENSITIVE MATERIAL USING TRIVALENT AND TETRAVALENT CERIUM COMPOUNDS

[75] Inventors: Shinpei Ikenoue; Yoshiaki Suzuki; Takao Masuda, all of Asaka, Japan

[73] Assignee: Fuji Photo Film Co., Ltd., Minami-ashigara, Japan

[21] Appl. No.: 711,741

[22] Filed: Aug. 4, 1976

[30] Foreign Application Priority Data

Oct. 31, 1974 [JP] Japan ..... 49-126240
Aug. 7, 1975 [JP] Japan ..... 50-96155

[51] Int. Cl.[3] ..... G03C 1/02
[52] U.S. Cl. ..... 430/620; 430/353; 430/608; 430/612; 430/613; 430/604
[58] Field of Search ..... 96/114.1, 110, 76, 48 HD, 96/67

[56] References Cited

U.S. PATENT DOCUMENTS

| | | | |
|---|---|---|---|
| 3,178,289 | 4/1965 | Sottysiak | 96/108 |
| 3,185,571 | 5/1965 | Thiers et al. | 96/110 |
| 3,351,469 | 11/1967 | Haes | 96/76 |
| 3,874,946 | 4/1975 | Costa et al. | 96/114.1 |
| 4,003,749 | 1/1977 | Masuda et al. | 96/114.1 |

FOREIGN PATENT DOCUMENTS 45-5383 2/1970 Japan .

*Primary Examiner*—Travis Brown
*Attorney, Agent, or Firm*—Sughrue, Rothwell, Mion, Zinn and Macpeak

[57] ABSTRACT

A thermally developable light sensitive material which comprises: (a) an organic silver salt; (b) a photocatalyst and (c) a reducing agent in a support or in one or more layers provided on the support additionally comprises (d) at least one cerium compound selected from trivalent and/or tetravalent cerium compounds in the support and/or in one or more of the above layers. An improvement in various characteristics such as a long green shelf life, a high degree of whiteness, low thermal fog, high sensitivity and so on is obtained.

17 Claims, No Drawings

THERMALLY DEVELOPABLE LIGHT SENSITIVE MATERIAL USING TRIVALENT AND TETRAVALENT CERIUM COMPOUNDS

BACKGROUND OF THE INVENTION

1. Field of the Invention

The present invention relates to a thermally developable light sensitive material, more particularly, it is concerned with a thermally developable light sensitive material which has improved characteristics by the addition of a trivalent and/or a tetravalent cerium compound thereto.

2. Description of the Prior Art

Thermally developable light sensitive materials utilizing a composition containing as essential components an organic silver salt, a small amount of silver halide and a reducing agent are disclosed in U.S. Pat. Nos. 3,152,904 and 3,457,075. In these light sensitive systems, silver halides remain in the light sensitive material after development and change in color upon light-exposure, i.e., they are not stabilized to light. Nevertheless, these systems produce satisfactory results, as well as the other system wherein residual silver halide receives a stabilizing treatment to light. This is because only a small amount of silver halide is used and a large portion of the silver component is present in the form of white or pale yellow organic silver salts which are stable to light so that they hardly blacken upon light-exposure. Thus, even if coloration results from the decomposition of residual silver halide caused by light-exposure, such slight coloration can hardly be perceived by the eye. In the above-described light sensitive systems, images are formed by the following mechanism: the oxidizing agent (organic silver salts) and the reducing agent incorporated in the light sensitive layer undergo a redox reaction in the presence of a catalytic amount of exposed silver halide when the system is heated to 80° C., preferably up to 100° C., after the completion of imagewise exposure, although the system is inert at ordinary temperature, resulting in the liberation of silver which causes a quick blackening in exposed areas of the light sensitive layer to produce contrast to unexposed areas (background).

In addition, thermally developable light sensitive materials of this kind include those which contain as a photocatalyst a light sensitive complex prepared from silver and a dye instead of the aforesaid silver halide, as disclosed in Japanese Applications (Laid-Open) 4728/71 and 28221/73, and Japanese Patent Publication 25498/74; and those which contain as organic silver salts a high sensitivity organic silver salt and a low sensitivity organic silver salt in combination, and, therefore, can be free of silver halide, as disclosed in Japanese Applications (Laid-Open) 8522/75. Accordingly, these thermally developable light sensitive materials are within those to which the technique of the present invention is applicable.

The addition of mercury compounds to thermally developable light sensitive materials improves the green shelf life thereof as disclosed in U.S. Pat. No. 3,589,903. However, mercury compounds are undesirable because they are, in general, highly toxic. Therefore, it is an important object to find compound of low toxicity which can serve as a substitute for a mercury compound.

SUMMARY OF THE INVENTION

It is, therefore, one object of the present invention to provide a thermally developable light sensitive material having an improved green shelf life.

Another object of the present invention is to provide a thermally developable light sensitive material having improved whiteness.

A further object of the present invention is to provide a thermally developable light sensitive material wherein increased thermal fog (corresponding to the fog produced in the background on thermal development) atrributable to storage prior to development is suppressed.

Still another object of the present invention is to provide a thermally developable light sensitive material which produces, on image-formation after prolonged storage, an image exhibiting a color tone equal to that of an image obtained just after the production of the light sensitive material.

Another object of the present invention is to provide a thermally developable light sensitive material wherein coloring of the background of the image obtained upon exposure to light (termed color change caused by light hereinafter) is reduced.

A further object of the present invention is to provide a thermally developable light sensitive material which exhibits high sensitivity.

Other objects of the present invention will be apparent from the disclosure herein and the appended claims.

The above-described objects are attained with a heat developable light sensitive material containing one or more trivalent and/or one or more tetravalent cerium compounds.

DETAILED DESCRIPTION OF THE INVENTION

A preferred embodiment of the present invention provides a thermally developable light sensitive material which comprises: (a) an organic silver salt; (b) a photocatalyst; and (c) a reducing agent in a support and/or in one or more layers provided on the support, and, further, (d) at least one cerium compound selected from trivalent and tetravalent cerium compounds in the support and/or in one or more layers thereon (where both trivalent and tetravalent cerium compounds can be used, if desired).

Component (d) which is the most characteristic component in the present invention comprises one or more trivalent and/or one or more tetravalent cerium compounds. Tetravalent cerium compounds remarkably improve green shelf life. In contrast, trivalent cerium compounds remarkably improve whiteness.

Preferred examples of trivalent or tetravalent cerium compounds include compounds represented by the following general formulae (I) and (II):

$$Ce_lX_m.xH_2O \quad (I)$$

$$M_nCe_pX_q.yH_2O \quad (II)$$

wherein Ce represents a trivalent or a tetravalent cerium atom; X represents an anion or a group capable of changing into an anion, specific examples of which include a nitrate ion, a hydroxide ion, an oxygen ion, a titanate ion, an acetate ion, an acetyl acetonate ion, a carbonate ion, a halogen ion (e.g., chlorine, bromine and iodine atoms), long chain aliphatic carboxylic groups (most preferably having 10 to 30 carbon atoms, e.g., laurate, palmitate, stearate and behenate groups), a perchlorate ion, a phosphorate ion and the like. Particularly preferred examples are a nitro ion, halogen ions and long chain aliphatic carboxylic groups; M represents a cation or a group capable of changing into a cation, specific examples of which include a hydrogen ion, an alkali metal ion (e.g., lithium, sodium, potassium, cesium and rubidium atoms), onium groups (e.g., ammonium groups, phosphonium groups, arsonium groups, stibonium groups, sulfonium groups, selenonium groups, staunoium groups, iodonium groups (of the above, $R_3N$ groups are preferred, wherein R represents H, an alkyl group having 1 to 22 carbon atoms, an aryl group having 6 to 22 carbon atoms, e.g., an $NH_4$ group, a tetramethylammonium group)); l,m, n, p and q represent integers necessary to render the compound neutral, for example, l is equal to 1 and m is equal to 4 when Ce is a tetravalent cerium atom, n is equal to 2, p is equal to 1 and q is equal to 6 when Ce is a tetravalent cerium atom, M is a monovalent cation and X is a monovalent anion, and l is equal to 2 and m is equal to 3 when Ce is a trivalent cerium atom and X is a divalent anion; and x and y each represents an integer (including zero; most preferably 0 to 16) which cannot be unequivocally defined because they depend upon the conditions of manufacture and storage (x and y, however, generally are such as give a high degree of deliquiscence; there are many commercial hydrates of this kind represented by the notation $.xH_2O$). In the present invention, a mixture of compounds having varying water crystallization degrees can be used, if desired.

Specific examples of trivalent and tetravalent compounds are given below; $Ce(OH)_3$, $Ce(OH)_4$, $CeO_2$, $Ce_2O_3$, $Li_8CeO_6$, $Na_2CeO_3$, $KCeO_2$, $K_2CeO_3$, CeN, $Ce(NO_3)_3$, $Ce(NO_3)_3.6H_2O$, $Ce(NO_3)_3.5H_2O$, $Ce(NO_3)_3.4H_2O$, $Ce(NO_3)_4.5H_2O$, $CeOH(NO_3)_3.xH_2O$, (x=0 and/or 3), $KCe(NO_3)_4.H_2O$, $K_2Ce(NO_3)_5$, $K_2Ce(NO_3)_6$, $RbCe(NO_3)_4.H_2O$, $Rb_2Ce(NO_3)_5.4H_2O$, $Rb_2Ce(NO_3)_6$, $CsCe(NO_3)_5.H_2O$, $(NH_4)_2Ce(NO_3)_6$, $NH_4.HCe(NO_3)_5.H_2O$, $(NH_4)_2Ce(NO_3)_5.xH_2O$ (x=0 and/or 4), $Ce(CH_3COO)_3.H_2O$, $(CH_3COCHCOCH_3)_3Ce$, $(NH_4)_2Ce(SO_4)_6.xH_2O$ (x=0,2 and/or 8), $Ce_2(CO_3)_3.8H_2O$, $CeCl_3.7H_2O$, $Ce_2(SO_4)_3.8H_2O$, $Ce(SO_4)_2.xH_2O$ (x=0, 2, 4, 5, 8, 9 and/or 12) $CeBr_3$, $Ce(TiO_3)_2$, $CeI_3.9H_2O$, $Ce(ClO_4)_3.6H_2O$, $CePO_4$, $Ce(C_{12}H_{25}COO)_3$, $Ce(C_{22}H_{45}COO)_3$, $Ce(C_{18}H_{37}COO)_3$ and the like.

Furthermore, cerium complex salts containing as ligands organic molecules may also be employed. As the ligands of the complex salts, nitrogen containing organic compounds and dibasic acids are preferred. Especially, nitrogen-containing heterocyclic compounds and dibasic acids, which have two carboxylic groups linked via 0 to 4 carbon atoms, are preferred, i.e., linkages between CO moities. As the specific examples of these ligands, mention may be made of 2,2'-bipyridyl, 1,10-phenanthroline, phthalocyanine, pyridine, quinoline, 8-hydroxyquinoline, urotropin, diphenic acid, naphthalic acid, phthalic acid, oxalic acid and the like.

Specific examples of cerium complex salts include $Ce(Dip)_2(NO_3)_3.xH_2O$ (where Dip is 2,2'-bipyridyl) (x=0 to 16), $Ce(Dip)_2Br_3$, $Ce(Phen)_2(NO_3)_3$ (where Phen is phenanthroline), $Ce(Phen)_2(SCN)_3$, Ce(Phtha)Br (where Phtha is phthalocyanine), $Ce(Uro)_2(SCN)_3.8H_2O$ (where Uro is urotropin), $Na_3[Ce(DP)_3]$ (where DP is diphenic acid), $Na[Ce(Naphth)_2]$ (where Naphth is naphthalic acid), $NH_4[Ce(OX)_2].xH_2O$ (where OX is oxalic acid) (x=0 to 16) and the like.

Component (d) may be incorporated into any photographic layer(s) of the thermally developable light sensitive material, and it matters little however and whenever component (d) is added thereto.

The amount of component (d) added cannot be given as a sweeping generalization because it depends upon what kinds of compounds are employed for each of the other components. However, as a guide, it can be said that the addition of from about $5\times10^{-1}$ mole to about $1\times10^{-5}$ mole of component (d) per mole of organic silver salt (a) produces desirable effects. A more preferred concentration range for component (d) is in the range of about $10^{-1}$ to about $10^{-4}$ mole per mole of organic silver salt (a).

The organic silver salt ingredient (a) in the present invention is a colorless or slightly colored silver salt comparatively stable against light, which reacts with a reducing agent to form a silver image when heated to not less than about 80° C., preferably not less than 100° C., in the presence of exposed silver halide. Such organic silver salts include silver salts of organic compounds having an imino group, a mercapto group, a thione group or a carboxy group. Specific examples thereof are as follows.

(1) Silver salts of organic compounds having an imino group: silver salt of benzotriazole, silver salt of nitrobenzotriazole, silver salt of an alkyl-substituted benzotriazole (e.g., methylbenzotriazole, etc.), silver salt of a halogen-substituted benzotriazole (e.g., silver salt of bromobenzotriazole, silver salt of chlorobenzotriazole, etc.), silver salt of a carboimido-substituted benzotriazole (e.g.,

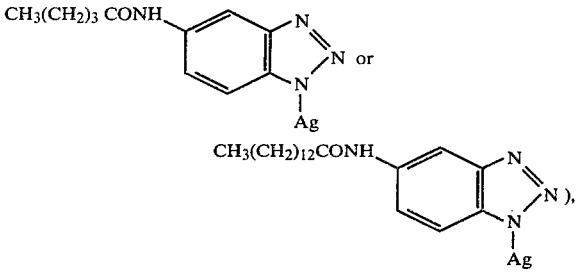

silver salt of benzomidazole, silver salt of a substituted benzimidazole (e.g., silver salt of 5-chlorobenzimidazole, silver salt of 5-nitrobenzimidazole, etc.) silver salt of carbazole, silver salt of saccharin, silver salt of phthalazinone, silver salt of a substituted phthalazinone, silver salts of phthalimides, silver salt of pyrrolidone, silver salt of tetrazole, silver salt of imidazole, N-(benzoic acid-sulfonic acid-(2)-imide) silver, N-(4-nitrobenzoic acid-sulfonic acid-(2)-imide)silver, N-(5-nitrobenzoic acid-sulfonic acid-(2)-imide) and other N-(benzoic acid sulfonic acid-(2)-imide)silvers, etc.

(2) Silver salts of mercapto group- or thione group-containing compounds: silver S-alkyl-thioglycolates wherein the alkyl substituent has 12 to 22 carbon atoms, as disclosed in Japanese Patent Application (CPI) 28221/73; silver salts of 2-alkylthio-5-(carboxylatemethylthio)-1,3,4-thiodiazoles, most preferably those wherein the alkyl group has from 12 to 22 carbon atoms, or silver salts of 3-(carboxylatemethylthio)-1,2,4-triazoles; silver salts of thione compounds as disclosed in U.S. Pat. No. 3,785,830 (wherein the thione compounds are represented by the following general formula

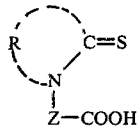

wherein R represents the atomic group necessary to complete a 5-membered heterocyclic ring, such as a thiazoline ring, imidazoline ring, pyrazoline ring, etc., and Z represents an alkylene group containing 1 to 10 carbon atoms.); silver S-2-aminophenylthiosulfate as disclosed in U.S. Pat. No. 3,549,379; 2-mercaptobenzoxazole silver, mercaptoxadiazole silver, 2-mercaptobenzothiazole silver, 2-(S-ethylthioglycolamide)benzothiazole silver, 2-mercaptobenzimidazole silver, 3-mercapto-4-phenyl-1,2,4-triazole silver, silver salts of mercaptotriazines, silver salts of 2-mercapto-5-aminothiadiazoles, silver salts of 1-phenyl-5-mercaptotetrazoles, silver salts of dithiocarbonates such as a silver salt of dithioacetate, thioamide silver, silver salts of thiopyridines such as 5-carbethoxy-1-methyl-2-phenyl-4-thiopyridine silver, dithiodihydroxybenzole silver, silver diethyldithiocarbamates, etc.

(3) Carboxy group-containing organic silver salts: (a) Silver salts of aliphatic carboxylic acids; silver caprate, silver laurate, silver myristate, silver palmitate, silver stearate, silver behenate, silver maleate, silver fumarate, silver tartarate, silver furoinate, silver linolate, silver oleate, silver hydroxystearate, silver adipate, silver sebacate, silver succinate, silver acetate, silver butyrate, silver camphorate, silver undecylenate, silver lignocerate, silver arachidonate, silver erucinate, silver oxalate, silver 10,12,14-octadecatrienoate, silver salts of thioether group containing aliphatic carboxylic acids as disclosed in, for example, U.S. Pat. No. 3,330,663; silver propionate, silver valerate, silver caproate, silver caprylate, silver t-butylhydroperoxide, silver malonate, silver glutarate, silver pimelate, silver azelainate, silver chloroacetate, silver trichloroacetate, silver fluoroacetate, silver iodoacetate, silver sarcosinate, silver aniline acetate, silver mandelate, silver hippurate, silver naphthalene acetate, silver creatinate, silver lactate, silver $\alpha$- or $\beta$-mercaptopropionate, silver levulinate, silver salts of amino acids such as L-alanine, $\gamma$-amino lactic acid, $\epsilon$-aminocapronic acid, L-aspartic acid, L-glutamic acid, L-leucine, etc., silver tricarballylate, silver nitrilotriacetate, silver citrate, silver ethylenediamine tetraacetate, silver acrylate, silver methacrylate, silver crotonate, silver sorbinate, silver itaconate, etc. (b) Silver salts of aromatic carboxylic acids; silver benzoate, silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenyl acetate, silver pyromellitate, silver salt of 4'-n-octadecyloxydiphenyl-4-carboxylic acid, silver m-nitrobenzoate, silver o-aminobenzoate, silver furoinate, silver p-hexoxybenzoate, silver octadecoxybenzoate, silver cinnamate, silver p-methoxycinnamate, silver furoate, silver p-nitrophenyl acetate, silver nicotinate, silver isonicotinate, silver picolinate, silver pyridine-2,3-dicarbonate, etc.

(4) Silver sulfonates:

silver ethane sulfonate, silver 1-propane sulfonate, silver 1-butane sulfonate, silver 1-pentane sulfonate, silver allyl sulfonate, silver benzene sulfonate, silver 1-n-butylnaphthalene-4-sulfonate, silver naphthalene-1,5-disulfonate, silver $\alpha$- or $\beta$-naphthalene sulfonate, silver p-toluene sulfonate, silver toluene-3,4-disulfonate, silver diphenylamine sulfonate, silver 2-naphthol-3,6-disulfonate, silver anthraquinone-$\beta$-sulfonate, silver 2-amino-8-naphthol-6-sulfonate, silver p-styrene sulfonate, etc.

(5) Silver sulfinates:

silver p-toluene sulfinate, silver p-acetoaminobenzene sulfinate, silver benzene sulfinate, etc.

(6) Silver organic phosphates:

silver phenyl phosphate, silver p-nitrophenyl phosphate, silver $\beta$-glycerophosphate, silver 1-naphthyl phosphate, silver adenocine-5'-3-phosphate, etc.

(7) Silver salts of macromolecular compounds:

silver polyacrylate, silver polyvinyl hydrogen phthalate, silver polystyrene sulfonate, etc.

(8) Other silver salts:

the silver salt of 4-hydroxy-6-methyl-1,3,3a,7-tetrazaindene, the silver salt of 5-methyl-7-hydroxy-1,2,3,4,6-pentazaindene, the silver salts of tetrazaindenes as disclosed in British Pat. No. 1,230,642; metal-containing aminoalcohols as disclosed in British Pat. No. 1,346,595; organic acid chelates of silver as disclosed in U.S. Pat. No. 3,794,496; silver 5-nitrosalicylaldoxime, silver 5-chlorosalicylaldoxime, silver salt of barbituric acid, silver picrate, silver rosinate, silver indophenol, the silver complex of cyclopentadiene, the silver complex of pyridine, the silver complex of cyclopentapolyene, the silver complex of N-vinylcarbazole, silver o-sulfobenzimide, etc.

In addition, oxidizing agents such as titanium oxide, zinc oxide, gold salts of carboxylic acids, e.g., gold laurate, gold stearate, gold behenate, etc., can be optionally employed together with the above described silver salts.

Of the above described organic silver salts, comparatively light stable organic silver salts are suitable when silver halides or light-sensitive complexes of silver and dyes as described in French Pat. No. 2,089,208 are used as photocatalysts. Silver salts of aliphatic carboxylic acids containing 10 to 35 carbon atoms are particularly preferred.

Such organic silver salts can be prepared according to various processes. The simplest process is to prepare organic silver salts by mixing a solution prepared by dissolving an organic silver salt-forming agent or a salt thereof in a water-miscible solvent (e.g., alcohol or acetone) or water, with an aqueous solution of a water-soluble silver salt (e.g., silver nitrate) as described in U.S. Pat. No. 3,457,075.

Furthermore, it is also possible to mix a colloidal dispersion of an ammonium or alkali metal salt of an organic silver salt-forming agent with an aqueous solution of a water-soluble silver salt (e.g., silver nitrate) as is described in British Pat. No. 1,347,350.

In a similar process, it is also possible to use an aqueous solution of a silver complex salt (such as a silver ammine complex salt or a solution prepared by dissolving such a silver complex salt in a water-miscible solvent in place of the aqueous solution of a water-soluble silver salt such as silver nitrate.

As other processes, U.S. Pat. No. 3,458,544 discloses mixing an oil-soluble solution which is substantially insoluble in water (such as a benzene solution) containing dissolved therein an organic carboxylic acid with an aqueous solution of a silver complex salt to prepare a silver salt of an organic carboxylic acid. Preferably, water is added to the oil-soluble solution to prepare an emulsion before mixing with the aqueous solution of the silver complex salt. Similar processing can be applied to other organic silver salts.

Japanese Patent Publication No. 30270/69 describes a similar process which, however, provides organic silver salts more stable against heat and light which comprises using a solution of an alkali-free silver compound, such as an aqueous solution of silver nitrate, in place of a silver complex salt. According to this process, the silver salt of benzotriazole can be obtained in high yield.

In addition, Japanese Patent Application No. 9362/73 describes a process for preparing organic silver salts. This process is preferred because a thermally developable light-sensitive material using an organic silver salt obtained according to this process suffers less heat fog. According to this process, organic silver salts are prepared by mixing an emulsion of an aqueous solution of an alkali metal salt or ammonium salt of a water-soluble organic silver salt-forming agent and an oil (e.g., benzene, toluene, cyclohexane, pentane, hexane, a carboxylic acid ester such as an acetate or phosphate, castor oil, etc., with a silver salt (silver nitrate, etc.) or a silver complex salt, preferably as an aqueous solution. As an alternative thereof, organic silver salts can be prepared by mixing an aqueous alkali solution with an oil-soluble solution (for example, a toluene solution) of an organic silver salt-forming agent and emulsifying the same, and thereafter mixing the resulting emulsion with a highly soluble silver salt such as silver nitrate or a silver complex salt such as a silver ammine complex salt, preferably as an aqueous solution. As the oil used for the preparation of the afresaid oily solutions, the following are generally used:

(1) phosphates: tricresyl phosphate, tributyl phosphate, monooctyldibutyl phosphate, etc.; (2) phthalic esters: diethyl phthalate, dibutyl phthalate, dimethyl phthalate, dioctyl phthalate, dimethoxyethyl phthalate, etc.; (3) carboxylic esters: acetic esters such as amyl acetate, isopropyl acetate, isoamyl acetate, ethyl acetate, 2-ethylbutyl acetate, butyl acetate, propyl acetate, etc., sebacic esters such as dibutyl sebacate, diethyl sebacate, etc., succinic esters such as diethyl succinate, etc., formic esters such as ethyl formate, propyl formate, butyl formate, amyl formate, etc., valeric esters such as ethyl valerate, etc., tartaric esters such as diethyl tartrate, etc., butyric esters such as methyl butyrate, ethyl butyrate, butyl butyrate, isoamyl butyrate, etc., adipic esters, etc.; (4) oils such as castor oil, cotton seed oil, linseed oil, tsubaki oil, etc.; (5) aromatic hydrocarbons such as benzene, toluene, xylene, etc.; (6) aliphatic hydrocarbons such as pentane, hexane, heptane, etc.; and (7) cyclic hydrocarbons such as cyclohexane, etc.

As the silver complex salts, there are preferably used alkali-soluble silver complex salts having a dissociation constant higher than that of the organic silver salts, such as a silver ammine complex salt, a silver methylamine complex salt, a silver ethylamine complex salt, etc.

As the solvents for silver salts such as silver nitrate, there can be used polar solvents such as dimethylsulfoxide, dimethylformamide, acetonitrile, etc., in addition to water.

Also, as is described in Japanese Patent Application No. 7619/73, it is possible to apply ultrasonic waves during the preparation of organic silver salts. In particular, application of ultrasonic waves upon emulsification of water and oil facilitates the emulsification. It is also possible to add a surface active agent during preparation of organic silver salts for the purpose of adjusting the grain size of the organic silver salts. Furthermore, organic silver salts may be prepared in the presence of a polymer. As a special process, it is known to mix a non-aqueous solution of an organic carboxylic acid with a non-aqueous solution of a heavy metal salt, e.g., a trifluoroacetate or tetrafluoroborate, in the presence of a polymer, to thereby prepare a heavy metal salt such as a silver salt of an organic carboxylic acid, as is described in U.S. Pat. No. 3,700,458. U.S. Pat. No. 3,748,143 also describes a process for preparing an emulsion using a similar non-aqueous solution.

As is described in Japanese Patent Application Nos. 49436/72 and 43867/72 and in West German Patent OLS No. 2,322,096, the grain shape and grain size of organic silver salts, and the photographic properties thereof such as heat fog, light stability, sensitivity, and the like, can be changed by the presence of a metal salt such as a mercury or lead compound or a metal complex during the preparation of organic silver salts. As the metal, cobalt, manganese, nickel and iron have been confirmed to be effective in addition to the above-described mercury and lead. These metal-containing compounds may be used by mixing a mixed solution or dispersion of a solution of a silver salt-forming organic compound and the metal-containing compound with an aqueous solution of a highly soluble silver salt such as silver nitrate or a silver complex salt such as a silver ammine complex salt with each other. Further, three components, i.e., a solution or dispersion of the metal-containing compound, an aqueous solution of a silver salt or a silver complex salt and a solution or dispersion of a silver salt-forming organic compound may be mixed with each other. Still further, mixing a solution or dispersion of a silver salt-forming organic compound with a mixed solution or dispersion of the silver salt or silver complex salt and the metal-containing compound is also preferred. The content of the metal-containing compound is preferably from about $10^{-6}$ to about $10^{-1}$ mol per 1 mol of the organic silver salt and from about $10^{-5}$ mol to about $10^{-2}$ mol per 1 mole of silver halide.

The thus prepared organic silver salt grains are from about $10\mu$ to about $0.01\mu$, preferably from about $5\mu$ to about $0.1\mu$, in length.

The light-sensitive silver halide used as ingredient (b) in the present invention can be silver chloride, silver bromide, silver iodide, silver chlorobromoiodide, silver chlorobromide, silver chloroiodide, silver bromoiodide or a mixture thereof. The amount thereof used ranges from about 0.001 mol to about 0.5 mol, preferably from about 0.01 mol to about 0.3 mol, per 1 mol of the organic silver salt. The light-sensitive silver halide may be coarse grain or fine grain, but the latter is preferred. A preferred grain size (length) of the silver halide ranges from about $1\mu$ to about $0.001\mu$, preferably from about $0.5\mu$ to about $0.01\mu$.

A light-sensitive silver halide per se can be prepared according to conventional processes known in the photographic field, such as a single jet process, double jet process, etc. For example, there can be used a Lippmann emulsion, an ammoniacal emulsion, a thiocyanate- or thioether-ripened emulsion, etc. Silver halide emulsions which are not washed or which have been washed with water, alcohol or the like to remove soluble salts may be used in the present invention. A light-sensitive silver halide thus previously prepared is mixed with an oxidation-reduction composition comprising an organic silver salt component (a), and a reducing agent, component (c), as described in U.S. Pat. No. 3,152,904.

However, it is clear that a "pre-prepared" silver halide obtained according to the process described in U.S. Pat. No. 3,152,904 often does not provide satisfactory light sensitivity due to insufficient contact between the silver halide and the organic silver salt, as described in U.S. Pat. No. 3,457,075. Therefore, various technique have been developed to effect sufficient contact between the silver halide and organic silver salt. One technique comprises adding a surface active agent to a coating solution which is to form a light-sensitive layer, examples of which are described in Japanese Patent Applications Nos. 82852/73 and 82851/73. Another technique comprises mixing the prepared silver halide with the organic silver salt in a polymer, examples of which are described in U.S. Pat. Nos. 3,705,565, 3,713,833, 3,706,564 and 3,761,273, British Pat. No. 1,354,186, French Pat. No. 2,078,586 and Belgian Pat. No. 774,436, etc. A still another useful technique is disclosed, for example, in British Pat. No. 1,354,186, etc., wherein a silver halide emulsion is decomposed with an enzyme, and then the resulting emulsion is mixed with an organic silver salt.

The silver halide used in the present invention may be prepared substantially simultaneously with the formation of the organic silver salt as described in German Patent Application OLS No. 2,428,125, if desired. As a specific example, a solution of a silver salt such as silver nitrate or a silver complex salt is mixed with a solution or dispersion of the aforesaid organic silver salt-forming compound or a salt thereof containing a light-sensitive silver halide-forming ingredient (to be described hereinafter), or a solution of a light-sensitive silver halide-forming agent is simultaneously mixed upon mixing a solution or dispersion of an organic silver salt-forming compound or a salt thereof with a solution of a silver salt such as silver nitrate and a silver complex salt, to thereby form light-sensitive silver halide simultaneously with the organic silver salt. It is possible to react a light-sensitive silver halide-forming ingredient (to be described hereinafter) with a previously prepared organic silver salt solution or dispersion, or to react the same on a sheet material containing an organic silver salt to thereby form light-sensitive silver halide in part of the organic silver salt. U.S. Pat. No. 3,457,075 describes that the thus formed silver halide is in effective contact with the organic silver salt and gives good results.

On the other hand, an ingredient capable of forming a light-sensitive silver halide is a compound capable of forming silver halide by acting on the organic silver salt. Such can be determined by a simple test as follows to see which compounds are effective. That is, the silver halide-forming ingredient is reacted with the organic silver salt, and, if desired, after heating, it is examined by X-ray diffraction analysis to determine whether the diffraction peak characteristic of silver halide exists or not. If the diffraction peak exists, the compound can be used.

As specific examples of ingredients capable of forming a light-sensitive silver halide there are illustrated the following compounds.

(1) Inorganic halides: halides represented by, e.g., $MX_n$ (wherein M represents H, $NH_4$ or a metal atom, X represents Cl, Br or I, and n represents 1 when M is H or $NH_4$, or, when M is a metal atom, n represents the valence of the metal, where examples of the metal atom include lithium, sodium, potassium, rubidium, cesium, copper, gold, beryllium, magnesium, calcium, strontium, barium, zinc, cadmium, mercury, aluminum, gallium, indium, lanthanum, ruthenium, thallium, germanium, tin, lead, antimony, bismuth, chromium, molybdenum, tungsten, manganese, rhenium, iron, cobalt, nickel, rhodium, palladium, osmium, iridium, platinum, etc.)

(2) Halogen-containing metal complexes: for example, $K_2PtCl_6$; $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RbCl_6$, $(NH_4)_3RhBr_6$, etc.

(3) Onium halides: quaternary ammonium halides (e.g., trimethylphenylammonium bromide, cetylethyldimethylammonium bromide, trimethylbenzylammonium bromide, etc.), quaternary phosphonium halides (e.g., tetraethylphosphonium bromide, etc.), tertiary sulfonium halides (e.g., trimethylsulfonium iodide, etc.), etc., can be added to a coating dispersion just prior to coating (for example, a coating dispersion for a light-sensitive layer, a protective layer, an undercoating layer or a back coating layer) for the purpose of reducing sensitivity, and, in some cases, background density, as is described in U.S. Pat. No. 3,679,422. Also, as is described in Japanese Patent Publication (OPI) No. 84443/74, a conductive high molecular weight polymer of the onium salt halide series can be used to prepare a thermally developable light-sensitive and electrosensitive material.

(4) Halogenated hydrocarbons: iodoform, bromoform, carbon tetrabromide, 2-bromo-2-methylpropane, etc.

(5) N-halogeno compounds: e.g., compounds which are represented by the following formulae (I) and (II)

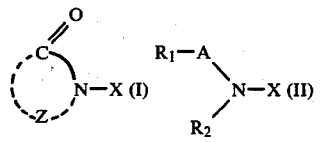

and N-halides containing an $—SO_2NX—$ group (III) (where X is Cl or Br), wherein for formulae (I) and (II), X represents Cl, Br or I, Z represents the atomic group necessary to form a 5- to 7-membered ring which may be further condensed with another ring, A represents a carbonyl group and $R_1$ and $R_2$ each represents a hydrogen atom, an alkyl group, an aryl group or an alkoxy group, as are disclosed in detail in Japanese Patent Application No. 126658/73. Specific examples thereof include N-chlorosuccinimide, N-bromosuccinimide, N-bromophthalimide, N-bromoacetoamide, N-iodosuccinimide, N-bromophthalazone, N-bromooxazolinone, N-chlorophthalazone, N-bromoacetoanilide, N,N-dibromobenzene sulfonamide, N-bromo-N-methylbenzene sulfonamide, 1,3-dibromo-4-,4-dimethylhydantoin, the potassium salt of dibromoisocyanuric acid, trichloroisocyanuric acid, etc., as disclosed in Japanese Patent Applications Nos. 126658/73, 19760/74, 81353/74, etc.; N-halogeno compounds of unsubstituted and substituted benzotriazoles the latter of which may be substituted with, for example, an alkyl group, most preferably an alkyl group having from 1 to 5 carbon atoms, a nitro group, a halogen atom, an imido group and an amino group; and N-halogeno compounds of benzimidazoles.

(6) Other halogen-containing compounds: triphenylmethyl chloride, triphenylmethyl bromide, 2-bromobutyric acid, 2-bromoethanol, dichlorobenzophenone, etc.

As previously described, component (d) employed in the present invention may be effectively added to a thermally developable light sensitive material at any time.

However, especially good results are obtained in the case where component (d) is added before or during the preparation of component (a), the organic silver salt(s). The following processes are preferably used for preparing the organic silver salts: (1) mixing a solution or a dispersion prepared by adding component (d) to a solution of a silver salt-forming organic compound with an aqueous solution of a water soluble silver salt such as silver nitrate, or with an aqueous solution of a silver complex salt such as a silver-amine complex salt; (2) simultaneously mixing three kinds of solutions consisting of a solution or a dispersion of component (d), an aqueous solution of a silver salt or a silver complex salt and a solution or a dispersion of a silver salt-forming organic compound; (3) mixing a solution or a dispersion of a silver salt-forming organic compound with a mixed solution or a dispersion prepared by adding component (d) to a solution of a silver salt or a silver complex salt.

Further, there is a relatively preferred method, wherein component (d) is added after the preparation of component (a), and further where component (d) is added during or before the preparation of component (b). This method includes the following procedures: preparing a light sensitive silver halide using a reactant solution for producing the light sensitive silver halide into which component (d) was, in advance, incorporated, according to one of the methods disclosed in U.S. Pat. No. 3,761,273; German Patent Application (OLS) No. 2,435,391; U.S. Pat. Nos. 3,706,565 and 3,713,833; and British Pat. Nos. 1,362,970 and 1,354,186; or adding component (d) to the reaction system for preparing the light sensitive silver halide according to the methods described above in the course of the reaction. In the case that both component (a) and the light sensitive silver halide are produced at nearly the same time, as disclosed in German Patent Application (OLS) No. 2,428,125, component (d) is incorporated into one of the reactant solutions prepared for the simultaneous formation of the above-described components before or during the formation of the organic silver salt and the silver halide. In the method of converting some portion of component (a) which has been previously prepared into the corresponding light sensitive silver halide by allowing the light sensitive silver halide-forming component to act upon component (a), it is preferred to add component (d) to the reactant solution in the progress of or prior to this conversion reaction. It is not always necessary to additionally add component (d) to the reactant solution when a trivalent or a tetravalent cerium compound is employed as a light sensitive silver halide-forming component.

In any of the above-described methods, it is preferred to add component (d) in the form of a solution, but it is possible to add component (d) in the form of a dispersion prepared by dispersing it into an appropriate solvent. The addition temperature for component (d) has no serious influence on the results of the present invention. As a guide, it is added at the temperature ranging from about 0° C. to about 80° C., preferably from 10° C. to 60° C.

Setting aside the mechanism of the improvements attained by the addition of component (d) in the present invention, the following results were particularly surprising in view of the research to date by the art, i.e., the improvement in the green shelf life, the whiteness and sensitivity of the thermally developable light sensitive materials due to component (d) of the present invention.

Using pre-prepared silver halides or using the mixing method wherein an organic silver salt is mixed with a silver halide-forming reactant, improvements in photographic properties such as an enhancement of sensitivity and a reduction of heat fog can be attained by storage for a suitable period of time (for example, 20 minutes–48 hours) at room temperature or at elevated temperature (30° C.–80° C.) after the addition of the silver halide-forming agent in the presence of, if desired, a sulfur-containing compound (e.g., a thiosulfate, etc.), a metal (e.g., gold, chromium, tin, lithium, palladium, etc.), a reducing agent or a combination of these compounds.

Similar improvements in photographic characterisitics can be achieved by applying a precipitation technique which is often employed in the art of producing gelatino silver halide emulsions wherein silver halide is allowed to form in the presence of a portion of a binder, the resulting silver salt is precipitated by means of a centrifugal separator, and then dispersed again into the remainder of the binder. When redispersion is carried out, the presence of nitric acid, a ferricyanide, thiocyanates, thiosulfates, benzotriazole, tetrazaindenes, mercapto compounds, thione compounds, iodides, heavy metal salts such as a rhodium salt, and the like can also be added to favorably alter photographic characteristics.

These silver halide-forming agents may be used alone or in combination. The amount thereof used ranges from about 0.001 mol to about 0.5 mol, preferably from about 0.01 mol to about 0.3 mol, per 1 mol of the organic silver salt. When the amount is less than the lower limit, low sensitivity often results, while when the amount is more than the upper limit, discoloration often increases upon exposure to light (unfavorable coloration in background areas caused when a processed light-sensitive material is left under room light).

Instead of silver halide, other photocatalysts can be used, if desired, as will now be discussed. Light sensitive complexes consisting of silver and dyes can be employed as a photocatalyst as disclosed in, for example, Japanese Patent Publication No. 25498/74 and Japanese Patent Applications (OPI) Nos. 4728/71 and 28221/73, and the combined use of a highly light-sensitive organic silver salt and an organic silver salt having low sensitivity is also effective, as is disclosed in Japanese Patent Application (OPI) No. 8522/75. Further, metal salts of diazosulfonate and sulfinic acid salts can also be used as a photocatalyst. In addition, photoconductive materials such as zinc oxide, titanium oxide, etc., can be used. Silver halide is the most suitable photocatalyst to obtain a highly sensitive thermally developable light sensitive material, however.

Silver halide produced in situ or pre-formed can be chemically sensitized using a chemical sensitizer such as a compound of sulfur, selenium, tellurium, gold, platinum, palladium, etc., a reducing agent such as silver, a tin halide, etc., or a combination thereof. Descriptions relating to such techniques are given in, e.g., U.S. Pat. Nos. 1,623,499, 2,399,083, and 3,297,447.

The light-sensitive silver halide emulsions used in the present invention preferably have added thereto an antifogging stabilizing agent such as a triazolium salt, an azaindene, a mercury salt, urazol, sulfocatechol, an oxime, nitron, nitroindazole, or the like, in order to stabilize them against fogging. Descriptions relevant to this art are given in, e.g., U.S. Pat. Nos. 2,728,663, 2,839,405, 2,566,263, 2,597,915, British Patent 623,448, etc.

Some optical sensitizing dyes which are effective for gelatino-silver halide emulsions also show a sensitizing action for the thermally developable light-sensitive material of the present invention. As effective optical sensitizing dyes, there can be illustrated cyanines, merocyanines, complex (tri- or tetranuclear) cyanines, holopolar cyanines, styryls, hemicyanines, oxonols, hemioxonols, etc. Of the cyanine dyes, those which possess a basic nucleus such as a triazoline nucleus, an oxazoline nucleus, a pyrroline nucleus, a pyridine nucleus, an oxazole nucleus, a thiazole nucleus, a selenazole nucleus, an imidazole nucleus, etc., are preferred. Such nuclei may be substituted with an alkyl group, an alkylene group, a hydroxyalkyl group, a sulfoalkyl group, a carboxyalkyl group, an aminoalkyl group or an enamine group capable of forming a fused carbon ring or a heterocyclic ring. As to the chemical structure thereof, symmetrical and unsymmetrical dyes can be used. Also, those which possess an alkyl group, a phenyl group, an enamine group, or a hetero substituent on the methine chain or polymethine chain thereof may be used. In particular, cyanine dyes having a carboxy group are effective for sensitization. Merocyanine dyes may possess an acidic nucleus such as a thiohydantoin nucleus, a rhodanine nucleus, an oxazolidinedione nucleus, a thiozolidinedione nucleus, a barbituric acid nucleus, a thiazolinone nucleus, a malononitrile nucleus, a pyrazolone nucleus, etc., in addition to the above-described basic nuclei. These acidic nuclei may further be substituted by an alkyl group, an alkylene group, a phenyl group, a carboxyalkyl group, a sulfoalkyl group, a hydroxyalkyl group, an alkoxyalkyl group, an alkylamine group or a heterocyclic nucleus. In particular, merocyanine dyes having an imino group or a carboxy group are effective.

If desired, these dyes may be used as various combinations thereof. Furthermore, supersensitizing additives which do not absorb visible light such as ascorbic acid derivatives, azaindenes, cadmium salts, organic sulfonic acids, etc., as described in, e.g., U.S. Pat. Nos. 2,933,390, 2,937,089, etc., may be used in combination therewith. As particularly effective sensitizing dyes for the thermally developable light-sensitive materials of the present invention, there can be illustrated merocyanine dyes having a rhodanine nucleus, a thiohydantoin nucleus or a 2-thio-2,4-oxazolidinedione nucleus, as described in U.S. Pat. No. 3,761,279, such as 3-p-carboxyphenyl-5-[β-ethyl-2-(3-benzoxazolylidene)ethylidene]-rhodanine, 5-[(3-β-carboxyethyl-2-(3-thiazolinylidene)ethylidene]-3-ethylrhodanine, 3-carboxymethyl-5-[(3-methylthiazolinylidene)-α-ethyl-ethylidene]rhodanine, 1-carboxymethyl-5-[(3-ethyl-2-(3H)-benzoxazolylidene)ethylidene]-3-phenyl-2-thiohydantoin, 5-[(3-ethyl-2-benzoxazolylidene)]-[1-methylethylidene]-3-[(3-pyrrolin-1-yl)-propyl]rhodanine, 3-ethyl-5-[(3-ethyl-2-(3H)-benzothiazolylidene)-isopropylidene]-2-thio-2,4-oxazolidinedione, 3-carboxymethyl-5-[(3-methyl-2-(3H)-thiazolinylidene)isopropylidene]rhodanine, 3-ethyl-5-[(3-methyl-2-thiazolinylidene)ethylidene]rhodanine, 3-ethyl-5-(1-methyl-2-(1H)-pyridylidene)rhodanine, 3-ethyl-5-(3,4-dimethyl-2(3H)-thiazolylidene)rhodanine, 1-carboxymethyl-5-(3-ethyl-2-benzoxazolylidene)-3-phenyl-2-thiohydantoin, 1-ethyl-[3-ethyl-2-(3H)-benzoxazolidiene)ethylidene]-3-n-butyl-2-thiohydantoin, 1-methyl-3-allyl-5-[2-(3-ethylbenzooxazolidene-(2)-ethylidene]-2-thiohydantoin, 1-carboxymethyl-3-(N-methylbenzothiazolylindyl)-4-thia-2-thiohydantoin, 5-[(3-ethyl-2-(3H)-naphtho-[2,1]-oxazolylidene)ethylidene]-3-n-hepthyl-2-thiohydantoin, 3-ethyl-5-[(3-ethyl-2-(3H)-naphtho-[2,1]-oxazolylidene)ethylidene]-1-phenyl-2-thiohydantoin, 3-allyl-5-[3-ethyl[(2-naphthoxazolylidene)ethylidene]-1-phenyl-2-thiohydantoin, 5-[(3-ethylthiazolidine-2-iridine)ethylidene]-3-allyl-2-thioxazolidine-2,4-dione, 3-ethyl-5-[(3-methyl-2-(3H)-benzothiazolidene)ethylidene]-2-thio-2,4-oxazolidinedione and merocyanine dyes represented by the following formulae:

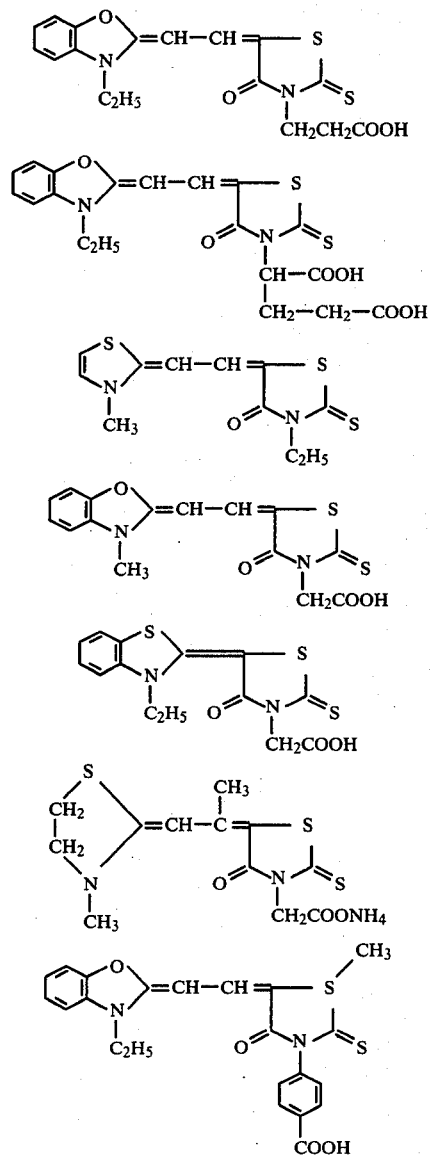

-continued

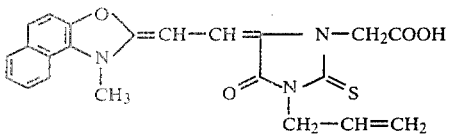

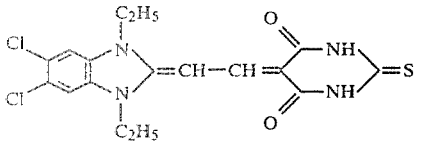

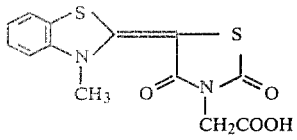

The merocyanine dyes effectively used in the present invention are not intended to be construed as being limited to the above examples.

Specific examples of cyanine dyes which can be used in the present invention are illustrated below. However, the invention is not limited to the dyes specifically described below.

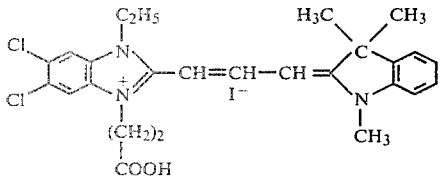

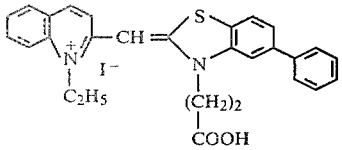

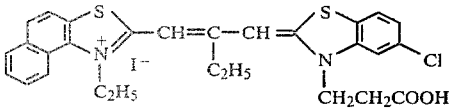

In addition, trinuclear merocyanine dyes as described in U.S. Pat. No. 3,719,495, polycyclic aromatic dyes as described in Belgian Pat. No. 788,695, sensitizing dyes mainly for silver iodide as described in Japanese Patent Publication (OPI) No. 17719/74, styrylquinoline dyes as described in Japanese Patent Publication (OPI) No. 84637/74, rhodacyanine dyes as described in West German OLS No. 2,405,713, acidic dyes (e.g., 2',7'-dichlorofluorescein dye) as described in West German Patents OLS Nos. 2,401,982, 2,404,591 and in Japanese Patent Applications Nos. 50903/73 and 81550/73, merocyanine dyes as described in Japanese Patent Applications Nos. 9565/74, 10815/74 and 63732/74, and the like may similarly be used. Specific examples of effective merocyanine dyes having a pyrazolone nucleus are as follows.

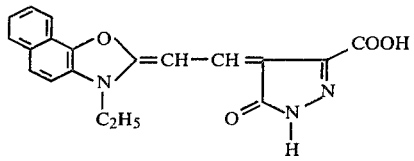

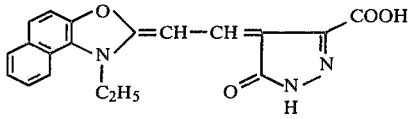

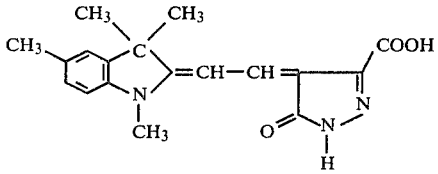

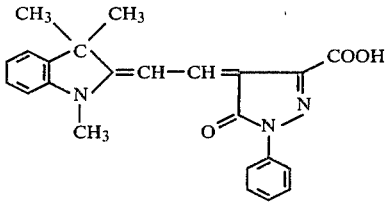

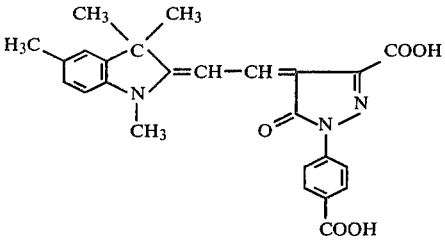

These dyes are added in an amount of from about $10^{-4}$ mol to about 1 mol per 1 mol of ingredient (b), the silver halide or silver halide-forming ingredient.

Further, when silver halide is not used, the sensitizing dyes as disclosed in Japanese Patent Application (OPI) Nos. 28221/73 and 91214/74 can also be employed. In such a case, it is more effective to heat the thermally developable light sensitive materials (up to a temperature of about 70° C. to about 120° C., typically, for about 1 second to about 30 seconds) before imagewise exposure.

Ingredient (c), the reducing agent, used in the present invention is one which can reduce the organic silver salt (ingredient (a)) upon being heated in the presence of exposed silver halide. Of such reducing agents, the one actually used is decided depending upon the kind and property of the organic silver salt used.

Specific examples of the reducing agent are as follows.

(1) Substituted phenols: aminophenols; e.g., 2,4-diaminophenol, methylaminophenol, p-aminophenol, o-aminophenol, 2-methoxy-4-aminophenol, 2-β-hydroxyethyl-4-aminophenol, 4-amino-2,6-dibromophenol, 4-amino-2-methylphenol sulfate, 4-amino-3-methylphenol sulfate, 4-amino-2,6-diiodophenol, 4-amino-2,6-dichlorophenol hydrochloride, N-methyl-p-aminophenol sulfate, 4-benzylideneaminophenol, 4-isopropylideneaminophenol, 4-isopropylideneaminophenol, 2,4-diamino-6-methylphenol, 4-acylaminophenol which contains an acyl group having 2 to 18 carbon atoms, N-(4-hydroxyphenyl)-aminoacetic acid, 4-hydroxyphenyl carbamic acid ethyl ester, 6-dimethylamino-3-hydroxytoluene, N-(4-hydroxyphenyl)-N'-alkyl urea which contains an alkyl group having 1 to 18 carbon atoms, N-(4-hydroxy-3,5-di-t-butylphenyl)-N'-octadecyl urea, N-(4-hydroxy-3,5-dichlorophenyl)-N'-octadecyl urea, 3-chloro-4-hydroxydiphenylamine, 4-(4-hydroxybenzylideneamino)-2-methylphenol, 4-(4-hydroxybenzylideneamino)-3-methylphenol, 4-(3-hydroxybenzylideneamino)phenol, α,α'-bis-(4-hydroxyphenylamino)-p-xylene, 4-benzylidene-amino-2-methylphenol, 4-(2-hydroxybenzylideneamino)-phenol, α,α'-bis(4-hydroxy-3-methylphenylimino)-p-xylene, 2-acylaminophenol which contains an acyl group having 1 to 18 carbon atoms, N-(2-hydroxyphenyl)-N'-alkyl urea which contains an alkyl group having 1 to 18 carbon atoms, 6-aminophenol sulfonic acid-(3)-amide, 6-aminophenol sulfonic acid-(3)-dimethylamide, 2-aminophenol sulfonic acid-(4)-amide, 2-benzylideneaminophenol, 4-(4-hydroxybenzylideneamino)phenol, α,α'-bis-(2-hydroxyphenylamino)-p-xylene, 3-(2-hydroxyphenyl-hydrazono)-2-oxo-oxolane, 3-(4-hydroxyphenylhydrazono)-2-oxo-oxolane, 4-hydroxyanilinomethane sulfonic acid, 4-hydroxy-3-methylanilinomethane sulfonic acid, etc.; alkyl substituted phenols, e.g., p-t-butylphenol, p-t-amylphenol, p-cresol, 2,6-di-t-butyl-p-cresol, p-ethylphenol, p-sec-butylphenol, 2,3-dimethylphenol, 3,4-xylenol, 2,4-xylenol, 2,4-di-t-butylphenol, 2,4,5-trimethylphenol, p-nonylphenol, p-octylphenol, 2,4,6-tri-t-butylphenol, 2,6-di-t-butyl-4-octylphenol, 2,6-di-t-butyl-4-ethylphenol, 2,4,6-tri-t-amylphenol, 2,6-di-t-butylphenol, 2-isopropyl-p-cresol, 3-methyl-3-(3-methyl-4-hydroxyphenyl)-pentane, 2,6-di-t-butyl-4-nonylphenol, 2,4-di-t-butyl-6-nonylphenol, etc.; aryl substituted phenols, e.g., p-phenylphenol, o-phenylphenol, α-phenyl-o-cresol, etc.; other phenols, e.g., p-acetophenol, p-acetoacetylphenol, 1,4-dimethoxybenzene, 2,6-dimethoxyphenol, chlorothymol, 3,5-di-t-butyl-4-hydroxybenzyldimethylamine, 2,6-dicyclohexyl-p-cresol, 2,6-di-t-butyl-4-methoxymethylphenol, 4-methoxyphenol, 2-methyl-4-methylmercaptophenol, 2,6-dicyclopentyl-p-cresol, 2-t-butyl-6-cyclopentyl-p-cresol, 2-t-butyl-6-cyclohexyl-p-cresol, 2,5-dicyclopentyl-p-cresol, 2,5-dicyclohexyl-p-cresol, 2-cyclopentyl-4-t-butylphenol, 3,5-di-t-butyl-4-hydroxybenzophenone, 3,5-di-t-butyl-4-hydroxy cinnamic acid, 3,5-di-t-butyl-4-hydroxybenzaldehyde, 3,5-di-t-butyl-4-hydroxy cinnamic acid ethyl ester and sulfonamide phenols as disclosed in U.S. Pat. No. 3,801,321; polyvinyl(2-hydroxy-3-methoxybenzal); hydroxyindanes as disclosed in German Patent Application (OLS) No. 2,319,080; hydroxycumarones and hydroxycumaranes as disclosed in U.S. Pat. No. 3,819,382; and novolak resin reaction products prepared from formaldehyde and phenol derivatives (e.g., 4-methoxyphenol, m-cresol, o- or p-t-butylphenol, 2,6-di-t-butylphenol and mixtures thereof).

(2) Substituted or unsubstituted bis, tris and tetrakisphenols: o-bisphenols [e.g., 1,1-bis-(2-hydroxy-3,5-dimethylphenyl)-3,5,5-trimethylhexane, bis(2-hydroxy-3-t-butyl-5-methylphenyl)methane, bis(2-hydroxy-3,5-di-t-butylphenyl)-methane, bis-(2-hydroxy-3-t-butyl-5-ethylphenyl)methane, 2,6-methylenebis(2-hydroxy-3-t-butyl-5-methylphenyl)-4-methylphenol, 1,1-bis(5-chloro-2-hydroxyphenyl)methane, 2,2'-methylenebis[4-methyl-6-(1-methylcyclohexyl)phenol], 1,1-bis-(2-hydroxy-3,5-dimethylphenyl)-2-methylpropane, 1,1,5,5-tetrakis-(2-hydroxy-3,5-dimethylphenyl)-2,4-ethylpentane, 3,3',5,5'-tetramethyl-6,6'-dihydroxy-triphenylmethane, 1,1-bis(2-hydroxy-3,5-di-t-butylphenyl)-pentane, 1,1-bis(2-hydroxy-3,5-di-t-butylphenyl)-ethane, 1,1-bis(2-hydroxy-3,5-di-t-butylphenyl)-propane, 1,1-bis-(2-hydroxy-3,5-di-t-butylphenyl)butane and 1,1-bis(2-hydroxy-3,5-di-t-amylphenyl)ethane)-1,1-bis(2-hydroxy-3-cyclohexyl-5-t-butylphenyl)methane, 1,1-bis(2-hydroxy-3-cyclopentyl-5-t-butylphenyl)-2,2-dimethylethane, bis(2-hydroxy-3-cyclopentyl-5-methyl-6-cyclopentylphenyl)sulfide, 1,1-bis(2-hydroxy-3-cyclopentyl-5-t-butylphenyl)butane, 1,1-bis(2-hydroxy-3cyclopentyl-5-t-butylphenyl)methane, 1,1-bis(2-hydroxy-3,5-di-cyclopentyl-6-methylphenyl)methane, 1,1-bis(2-hydroxy-3,6-di-cyclopentyl-5-methylphenyl)methane, bis(2-hydroxy-3-cyclopentyl-5-t-butylphenyl)sulfide, bis(2-hydroxy-3-cyclohexyl-5-t-butylphenyl) sulfide, 1,1-bis(2-hydroxy-3-t-butylphenyl)methane, p-cresol-acetoaldehyde or formaldehyde-novolak resins, bis(2-hydroxy-3-t-butyl-5-methylphenyl) sulfide, 1,1-bis(2-hydroxy-3,5-dimethylphenyl)methane, 1,1-bis(2-hydroxy-3,5-di-t-butylphenyl)-2-methylpropane, 1,2-bis(2-hydroxy-3-t-butyldibenzofuryl)ethane, and 3,3',5,5'-tetra-t-butyl-6,6'-dihydroxytriphenylmethane]; p-bisphenols (e.g., bisphenol A, 4,4'-methylenebis(3-methyl-5-t-butylphenol), 4,4'-methylenebis(2,6-di-t-butylphenol), 3,3',5,5'-tetra-t-butyl-4,4'-dihydroxybiphenyl, 4,4'-dihydroxybiphenyl, 1,1-bis(4-hydroxyphenyl)cyclohexane, 2,2-bis(3,5-dibromo-4-hydroxyphenyl)propane, 2,2-bis(3,5-dichloro-4-hydroxyphenyl)propane, 2,2-bis(3,5-dimethyl-4-hydroxyphenyl)propane, 2,2-bis(3-methyl-4-hydroxyphenyl)propane, bis(3-methyl-4-hydroxy-5-t-butylphenyl)sulfide, 2,2-bis(4-hydroxy-3,5-di-t-butylphenylthio)propane, 4,4'-butylidenebis(6-t-butyl-3-methylphenol), 4,4'-thiobis (6-t-butyl-3-methylphenol), 4,4'-thiobis(6-t-butyl-2-methylphenol), 4,4'-butylidenebis(6-methylphenol), 4,4'-benzylidene-bis (2-t-butylphenol), 4,4'-ethylidenebis (6-t-butyl-o-cresol), 4,4'-ethylidenebis (2-t-amylphenol), 4,4'-(p-chlorobenzylidene)-di-(2,6-xylenol), 4,4'-ethylidenebis (2-cyclohexylphenol), 4,4'-pentylidene-di-(o-cresol), 4,4'-(p-bromo-benzylidene)-di-phenol, 4,4'-propylidene-bis (2-phenylphenol), 4,4'-ethylidene-di-(2,6-xylenol), 4,4'-heptylidene-di-(o-cresol), 4,4'-ethylidene-bis (2,6-di-t-butylphenol), 4,4'-(2-butenylidene)-di-(2,6-xylenol), 4,4'-(p-methylbenzylidene)di-(o-cresol), 2,2-bis(3-methyl-4-hydroxy-5-t-butylphenyl)propane, α,α'-(4-hydroxy-3,5-di-t-butylphenyl)dimethyl ether, 4,4'-dihydroxy-3,3',5,5'-tetra-t-butyl-biphenyl, 4,4'-dihydroxy-3,3'-dimethylbiphenyl, 2,2-bis(3-methyl-4-hydroxy-5-t-butylphenyl)propane, 2,2-bis-(4-hydroxy-3,5-di-t-butylphenyl)propane, 2,2-bis(4-hydroxy-3,5-diethylphenyl)-propane, 2,2-bis(4-hydroxy-3-methyl-5-t-amylphenyl)-propane, 2,2-bis(4-hydroxy-3,5-di-t-amylphenyl)propane, polyphenols (e.g., 2,4,6-tris(3,5-di-t-butyl-4-hydroxybenzyl)phenol, N,N'-di(4-hydroxyphenyl)urea, tetrakis[methylene-(3,5-di-t-butyl-4-hydroxyhydrocinnamato)methane etc.], diethylstilbestrol, hexestrol, bis(3,5-di-t-butyl-4-hydroxybenzyl)ether, 2,6-bis(2'-hydroxy-3',t-butyl-5'-methylbenzyl)-4-methylphenol, etc.

(3) Substituted or unsubstituted mono- or bis-naphthols and di- or polyhydroxynaphthalenes: bis-β-naphthols (e.g., 2,2'-dihydroxy-1,1'-binaphthyl, 6,6'-dibromo-2,2'-dihydroxy-1,1'-binaphthyl; 6,6'-dinitro-2,2'dihydroxy-1,1'-binaphthyl, bis(2-hydroxy-1-naphthyl)methane, 4,4'-dimethoxy-1,1'-dihydroxy-2,2'-binaphthyl, etc.), naphthols (e.g., α-naphthol, β-naphthol, 1-hydroxy-4-amino-naphthalene, 1,5-dihydroxynaphthalene, 1,3-dihydroxynaphthalene, 1-hydroxy-2-phenyl-4-methoxynaphthalene, 1-hydroxy-2-methyl-4-methoxynaphthalene, 1-hydroxy-4-methoxynaphthalene, 1,4-dihydroxynaphthalene, methylhydroxynaphthalene, 1-amino-2-naphthol-6-sodium-sulfonate, 1-naphthylamine-7-sulfonic acid, etc.), 2,3-dihydroxynaphthalene, 1-hydroxy-2-carboxynaphthalene, 1-hydroxy-4-methoxy-dihydronaphthalene, 2-hydroxy-3-carboxynaphthalene, 1-hydroxy-4-ethoxynaphthalene, 1-hydroxy-4-propoxynaphthalene, 1-hydroxy-4-isopropoxynaphthalene, 1-hydroxy-5-methoxynaphthalene, morpholino-(1-hydroxy-4-methoxynaphthyl-(2))-methane, sulfonamide naphthols as disclosed in U.S. Pat. No. 3,801,321; 2-hydroxy-3-aminonaphthalene and 1-hydroxy-5-acylaminonaphthalene which contains an acyl group having 1 to 18 carbon atoms; etc.

(4) Di- or poly-hydroxybenzenes and hydroxymonoethers: hydroquinone, alkyl substituted hydroquinone (most preferably an alkyl group having 1 to 5 carbon atoms, e.g., methylhydroquinone, t-butylhydroquinone, 2,5-dimethylhydroquinone, 2,6-dimethylhydroquinone, t-octylhydroquinone, etc.), halogen substituted hydroquinones (e.g., chlorohydroquinone, dichlorohydroquinone, bromohydroquinone, etc.), alkoxy substituted hydroquinone (most preferably an alkoxy group having 1 to 5 carbon atoms, e.g., methoxyhydroquinone, ethoxyhydroquinone), other substituted hydroquinones (e.g., phenylhydroquinone, etc.), hydroquinone monosulfate, 2,5-dihydroxyalkyl ($C_1$ to $C_{18}$ alkyl moieties are preferred) hydroquinone, 2-ethoxycarbonylhydroquinone, acetylhydroquinone, 2-cyclohexylhydroquinone, (2,5-dihydroxyphenyl)-5-(1-phenyltetrazolyl)sulfide, (6-methyl-2,5-dihydroxyphenyl)-5-(phenyltetrazolyl)sulfide, (2,5-dihydroxyphenyl)-2-(benzothiazolyl)sulfide, 2-dodecyl-5-(5-carboxypentyl)hydroquinone, 2-dodecyl-5-(9-carboxynonyl)hydroquinone, 2-tetradecyl-5-(5-carboxypentyl)hydroquinone, 2-tetradecyl-5-(9-carboxynonyl)hydroquinone, etc.; hydroquinone monoethers (e.g., p-methoxyphenol- or p-ethoxyphenol-hydroquinone monobenzyl ether, 2-t-butyl-4-methoxyphenol- or 2,5-di-t-butyl-4-methoxyphenol-hydroquinone mono-n-propyl ether, hydroquinone mono-n-hexyl ether; and others, e.g., catechol, 4-phenylcatechol, 3-(dihexylaminomethyl)-5-phenylcatechol, 3-(di-n-hexylaminomethyl)-5-phenylcatechol, 3-cyclohexylpyrocatechol, 4-cyclohexylpyrocatechol, 4-(α-methylbenzyl)pyrocatechol, dicyclohexylpyrocatechol, 5-(N,N-dihexylaminomethyl)-4-phenylcatechol, 4-lauroylcatechol, t-butylcatechol, pyrogallol, azeloyl pyrogallol, 4-stearoyl pyrogallol, di-t-butylpyrogallol, butyryl pyrogallol, 4-azeloyl bipyrogallol, phloroglucinol, resorcinol, 4,6-di-t-butylresorcinol, 4-alkyl resorcinol which contains an alkyl group having 1 to 18 carbon atoms, 1-chloro-2,4-dihydroxybenzene, 3,5-di-t-butyl-2,6-dihydroxybenzoic acid, 2,4-dihydroxybenzoic acid, 2,4-dihydroxyphenyl sulfide, 2,3-dihydroxybenzoic acid, 3,4-dihydroxybenzoic acid, 2,5-dihydroxybenzoic acid, o-aminobenzoic acid, m-aminobenzoic acid, p-aminobenzoic acid, protocatechuic aldehyde, ethyl protocatechuate, ethyl protocatechuate, 4-(3',4'-dihydroxyphenylazo)benzoic acid, 3,4-dihydroxyphenylacetic acid, 1-acetyl-2,3,4-trihydroxybenzene, 2,2'-methylenebis(3,4,5-trihydroxyphenyl)benzoic acid, gallic acid, methyl gallate, propyl gallate, butyl gallate, sodium gallate, ammonium gallate, dodecyl gallate, ethyl gallate, isopropyl gallate, gallic anilide, 3,4,5-trihydroxyacetophenone, etc.; etc.

(5) Ascorbic acid and derivatives thereof: l-ascorbic acid, isoascorbic acid, ascorbic acid monoesters (e.g., the monolaurate, monomyristate, monopalmitate, monostearate, monobehenate, monobenzoate, 6-palmitate-5-β-carboxypropionate-6, etc., of ascorbic acid), diesters of ascorbic acid (e.g., the dilaurate, dimyristate, dipalmitate, distearate, etc., of ascorbic acid). As the ascorbic acids, those described in U.S. Pat. No. 3,337,342 can also be used.

(6) 3-Pyrazolidones, pyrazolines and pyrazolones: 1-phenyl-3-pyrazolidone, 4-methyl-4-hydroxymethyl-1-phenyl-3-pyrazolidone, those described in British Pat. No. 930,572, 1-(2-quinolyl)-3-methyl-5-pyrazolone, etc.

(7) Reducing sugars: glucose, lactose, etc.

(8) Phenylenediamines: e.g., o-phenylenediamine, p-phenylenediamine, N,N'-dimethyl-p-phenylenediamine, N,N'-diethyl-p-phenylenediamine, N-phenyl-N'-isopropyl-p-phenylenediamine, N,N'-dibenzylidene-p-phenylenediamine, N,N-diethyl-N'-sulfomethyl-p-phenylenediamine, N-benzylidene-N',N'-diethyl-p-phenylenediamine, N,N-dimethyl-N'-sulfomethyl-p-phenylenediamine, 3-methoxy-4-sulfomethylamino-N,N-diethylaniline, N,N'-di-sulfomethyl-p-phenylenediamine, N-(2-hydroxybenzylidene)-N',N'-diethyl-p-phenylenediamine, N-(3-hydroxybenzylidene)-N',N'-diethyl-p-phenylenediamine, N-(4-hydroxybenzylidene)-N',N'-diethyl-p-phenylenediamine, N,N-diethyl-3-methyl-p-phenylenediamine, N,N-diethyl-p-phenyleneamine trifluoroacetate, hydroxyethylparamine and the like, which can provide color images by using them together with phenolic or active methylenic color couplers as disclosed in U.S. Pat. Nos. 3,531,286 and 3,764,328; and can also provide color images in accordance with the method as disclosed in U.S. Pat. No. 3,761,270.

(9) Hydroxyamines: e.g., hydroxyamines as disclosed in U.S. Pat. No. 3,667,958 and Japanese Patent Application (OPI) No. 28,221/73, etc.

(10) Reductones: e.g., aminohexose reductones, anhydroaminohexose reductones and anhydrodihydroaminohexose reductones, as disclosed in U.S. Pat. No. 3,679,426; linear amino reductones as disclosed in Belgian Pat. No. 786,086; etc.

(11) Hydroxyaminic acids: e.g., hydroxaminic acids as disclosed in U.S. Pat. Nos. 3,751,252 and 3,751,255; etc.

(12) Hydrazides: e.g., hydroxy substituted fatty acid arylhydrazides as disclosed in U.S. Pat. No. 3,782,949; etc.

(13) Others: e.g., indane-1,3-diones, each of which contains at least one hydrogen atom at the 2-position as disclosed in U.S. Pat. No. 3,773,512; amidoximes as disclosed in U.S. Pat. No. 3,794,488; substituted hydropyridines as disclosed in German Patent Application (OLS) No. 2,308,766; organic hydrazone compounds as disclosed in U.S. Pat. No. 3,615,533; hydrazines as disclosed in U.S. Pat. No. 3,667,958; amino-9,10-dihydroacridines; 1,4-dihydropyridines as disclosed in U.S. Pat. No. 3,839,048; acetoacetonitriles; homogentisic acid and homogentiso amides; hydroxytetronic acids and hydroxytetronimide; kojic acid; hinikitiol; p-oxyphenylglycine; 4,4'-diaminodiphenyl; 4,4'-dimethylaminodiphenyl; 4,4',4''-diethylaminotriphenylmethane; spiroindane; and 4-methylesculetine.

Of the above described reducing agents, phenols which contain an alkyl group, e.g., a methyl, ethyl, propyl, isopropyl or butyl group, or an acyl group at at least one position adjacent to the position having a hydroxyl substituent in an aromatic nucleus, for example, 2,6-di-t-butylphenol group containing mono-, bis-, tris- or tetrakis-phenols, have the characteristic of only a slight color change under light exposure because they are stable to light.

The combined used of these phenolic reducing agents and silver salts of fatty acids particularly exerts a desirable effect, as disclosed in, for example, German Patent Application (OLS) No. 2,321,328; and Japanese Patent Application Nos. 81625/73, 22135/74, 55114/74, 89603/74, 105290/74 and 126366/74.

Moreover, as disclosed in U.S. Pat. No. 3,827,889, reducing agents capable of being deactivated by light exposure, such as photolytic reducing agents, are well suited for use in the present invention because a reducing agent of this kind will be deactivated or decomposed by light when a photographic material containing such a reducing agent is allowed to stand in a bright room after development, resulting in a cessation of reduction, and, therefore, a cessation of color changes. Specific examples of photolytic reducing agents include ascorbic acid and the derivatives thereof, furoin, benzoin, dihydroxyacetone, glycerine aldehyde, rhodisonic tetrahydroxyquinone, 4-methoxy-1-naphthol and so on. As disclosed in U.S. Pat. Nos. 3,827,889 and 3,756,829, a direct positive image can be produced by using such a photolytic reducing agent in the case of making heat developable light sensitive materials and exposing them to light in an imagewise fashion in order to decompose the reducing agent. Further, compounds capable of accelerating the photolysis of the reducing agent can additionally be employed, if desired.

The most preferred reducing agents are 2,4-dialkyl substituted orthobisphenols, 2,6-dialkyl substituted parabisphenols or mixtures thereof. For example, reducing agents represented by the following general formulae are very preferred for use in the present invention:

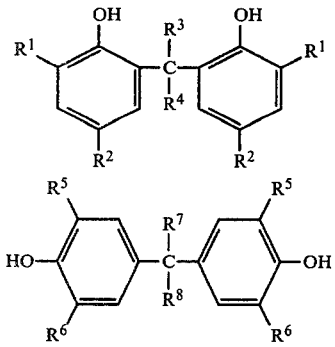

wherein $R^1$, $R^2$, $R^5$ and $R^6$ each represents an alkyl group containing one to five carbon atoms, a cyclopentyl group or a cyclohexyl group, and $R^3$, $R^4$, $R^7$ and $R^8$ each represents a hydrogen atom, an alkyl group containing one to eight carbon atoms, an aryl group (e.g., a phenyl group, a naphthyl group, etc.), a substituted aryl group (e.g., a carboxyphenyl group, a halogen substituted phenyl group, an alkoxy substituted phenyl group, a nitro substituted phenyl group, etc., are as disclosed in detail in German Patent Application (OLS) No. 2,321,328, or an aralkyl group (e.g., a benzyl group, $\beta$-phenylethyl group, etc.).

Suitable reducing agents are selected depending upon the kind (property) of the organic silver salt(s) used (ingredient (a)). For example, a stronger reducing agent is suitable for silver salts which are comparatively difficult to reduce such as the silver salt of benzotriazole, silver behenate, etc., whereas weaker ones are suitable for silver salts which are comparatively easy to reduce such as silver caprate, silver laurate, etc. As the reducing agent for the silver salt of benzotriazole, there are 1-phenyl-3-pyrazolidones, ascorbic acid, ascorbic acid monocarboxylic acid esters, naphthols (e.g., 4-methyl-1-naphthol, etc.), and the like. As the reducing agent for silver behenate, there are many compounds such as o-bisphenols of the bis(hydroxyphenyl)methane series, hydroquinone and the like. Also, as the reducing agent for silver caprate and silver laurate, there are substituted tetrakisphenols, o-bisphenols of the bis(hydroxyphenyl)alkane series, p-bisphenols (e.g., a bisphenol A derivative), p-phenylphenols, and the like. Acceptable reducing agents/organic silver salt combinations can easily be determined by a simple test. For example, a sample of the reducing agent is mixed with a coating solution containing the organic silver salt, and the mixed coating solution coated on the support. The resulting heat-developable light-sensitive sample is then exposed and heated; examination at this stage easily permits one skilled in the art to determined optimum combinations.

The amount of the reducing agent used in the present invention varies depending upon the kind of the organic silver salt or the reducing agent and upon other additives, but, in general, a suitable amount ranges from about 0.05 mol to about 10 mols, preferably from about 0.1 to about 3 mols, per 1 mol of the organic silver salt.

The above-described various reducing agents may be used as combinations of two or more thereof. Specific examples of using two reducing agents in combination are described in Japanese Patent Application No. 27242/73 and U.S. Pat. Nos. 3,667,958, and 3,751,249. As a particularly effective combination of reducing agents, there are illustrated the combination of at least one carboxylic acid ester derived from a phenol having a bulky o-substituent and an o- or p-bisphenol, the carboxylic acid ester being the aforesaid ester between a carboxylic acid derived from a phenol having a bulky o-substituent and a mono- or poly-hydric alcohol or a phenol or the ester between an alcohol derived from a polyhydric phenol having a bulky o-substituent or from a phenol having a bulky o-substituent and a mono- or poly-carboxylic acid. This combination enables one to attain a reduction of heat fog, an increase in whiteness and a stabilization against light exposure after processing. In addition, the combined use of two mono- or poly-phenolic reducing agents having alkyl groups at the two substitution positions adjacent the hydroxy-substituted position of the aromatic nucleus is effective for preventing discloration upon exposure to light. Further, it has been confirmed that development can be accelerated by the combined use of a compound of tin, iron, cobalt or nickel, for example, a metal salt of a long chain fatty acid, e.g., iron stearate, lead behenate, etc. (such compounds are auxiliary reducing agents), and the reducing agent. The amounts of these auxiliary reducing agents vary widely depending upon the reducing power of the main reducing agent and the auxiliary reducing agent and the reducibility of the oxidizing agent (the organic silver salt), but, in general, they are used in an amount of from about $10^{-5}$ to about 1 mol, preferably from $10^{-3}$ to 0.8 mol, per 1 mol of the main reducing agent.

A color toning agent can be used together with these reducing agents. The color toning agent is preferably used for producing images of a dark tone, especially a black tone. The color toning agent is most effective when used in a concentration ranging from about 0.0001 mole to about 2 moles, preferably from about 0.0005 mole to about 1 mole, per mole of the organic silver salt. The choice of an effective toning agent is made according to the organic silver salt and the reducing agent used. The most commonly used color toning agents include heterocyclic organic compounds containing a

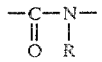

unit (wherein R represents a hydrogen atom, a hydroxy group, a metallic ion such as $Na^+$, $Li^+$, $Ag^+$ or K, an acyl group having 2 to 10 carbon atoms such as an acetyl group, a propionyl group, etc., and the like) such as phthalazinones, oxazinediones, cyclic imides, quinazolinones, N-hydroxyphthalimides, urazoles, 2-pyrazoline-5-ones and the like. Specific examples of color toning agents of this kind are; phthalazoinone, 2-acetylphthalazinone, 2-phthalylphthalazinone, N-methylphthalazinone, 2-pivaloylphthalazinone, 2-carbamoylphthalazinone, 2-(3,4-dimethoxybenzoyl)phthalazinone, 2-lauroylphthalazinone, 2-benzoylphthalazinone, 2-(p-methoxybenzoyl)phthalazinone, 2-ethoxyformylphthalazinone, phthalazinone derivatives as disclosed in Japanese Patent Application No. 116022/73 and U.S. Pat. No. 3,844,797; phthalazinone salts such as phthalazinone silver, quinazolinediones and benzoxazinediones or naphthooxazinediones as disclosed in Japanese Patent Applications (Laid-Open) No. 91215/74 and 2524/75, cyclic imides such as substituted phthalimides as disclosed in German Patent Applications (OLS) Nos. 2,140,406 and 2,141,063; quinazolines as disclosed in U.S. Pat. No. 3,846,136; pyrazoline-5-ones, N-hydroxynaphthalimides as disclosed in U.S. Pat. No. 3,782,941; mercapto compounds as disclosed in U.S. Pat. No. 3,832,186 and Japanese Patent Application (Laid-Open) No. 5020/74, phthalazinediones as disclosed in Japanese Patent Application No. 116471/73, uracils as disclosed in Japanese Patent Application No. 18378/74, barbitals, saccharin, 5-nitrosaccharin, phthalic anhydride, 2-mercaptobenzoxazole, 2-hydroxybenzothiazole, 2-amino-6-methylbenzothiazole, 2-amino-4-(4-biphenylyl)thiazole, imidazole, 2-hydroxybenzimidazole, N,N'-ethylenethiourea and 1-acetyl-2-thiohydantoin.

Also, the combined use an imidazole and phthalic acid or naphthoic acid or phthalamide acid can gives images of a black tone, as disclosed in U.S. Pat. No. 3,847,612. Another preferred example is the combined used of phthalazinone and 2-acylphthalazinone. The simultaneous use of two or more kinds of the above-described color toning agents can produce various desirable photographic results. The color toning agents may be incorporated in the support in a backing layer, in a subbing layer provided on the support or in the finally coated layer. Good results can be obtained in all cases.

Various methods can be used to further prevent thermal fog from occurring in thermally developable light sensitive materials of the present invention. For this purpose, N-halogeno compounds such as N-halogenosuccinimide, N-halogenoacetamide, N-halogenooxazolinone, N-halogenobenzotriazole, N-halogenobenzimidazole, N,N'-dichloro-1,2-ethylenebisbenzamide and the like can be employed, as disclosed in, for example, Japanese Patent Applications (Laid-Open) Nos. 10724/74, 97613/74 and 90118/74, and Japanese Patent Application No. 94847/74. In another method for preventing thermal fog, a wide variety of acidic compounds and salts thereof can be employed, as disclosed in Japanese Patent Applications (Laid-Open) Nos. 125016/74, 130720/74 and 89720/73; U.S. Pat. No. 3,645,739; and Japanese Patent Applications Nos. 106724/73, 121631/74, 29463/74, 131827/74, 128767/74, 187/75 and 299/75. Specific examples of these acids include lauric acid, myristic acid, palmitic acid, stearic acid, behenic acid, succinic acid, maleic acid, tetrahalogenophthalic acid or the anhydrides thereof, aryl sulfonic acids such as benzene sulfonic acid and p-toluene sulfonic acid, aryl sulfinic acids such as benzene sulfinic acid and p-toluene sulfinic acid or the salts thereof, citric acid, rosins which have an oxidation value greater than 120 e.g., gum rosin, wood rosin, hydrogenated rosin, etc., salicylic acid, alkyl substituted benzoic acids such as p-hydroxybenzoic acid, 2,6-dihydroxybenzoic acid, tetrabromobenzoic acid, p-acetoamide benzoic acid, p-t-butylbenzoic acid and the like, phthalic acid, isophthalic acid, trimellitic acid, pyromellitic acid, diphenic acid, 5',5'-methylenbis-salicylic acid, capric acid, arachidic acid, lignoceric acid, cerotic acid, linolic acid, oleic, adipic acid, sebacic acid, dimethyl stearic acid, dimethyl behenic acid, cinnamic acid, o-phthalamine acid, diterpenes, e.g., abietic acid, pimaric acid, iso-d-pimaric acid, neoabietic acid, levoabietic acid and the like, alkali salts or esters of benzenethiosulfonic acid and combinations thereof. As examples of proper combinations, mention may be made of the combination of a sulfinic acid and a polyhalogenophthalic acid, the combination of a sulfinic acid and a rosin, the combination of a sulfinic acid and a diterpenic acid and the combination of a thiosulfonic acid and an imidazole.

Lithium salts of higher fatty acids such as lithium myristate, lithium stearate, lithium behenate, lithium palmitate, lithium laurate and the like can be employed as a thermal fog stabilizer. As other examples of compounds which can effectively prevent thermal fog from occurring mention may be made of benzotriazole and derivatives thereof, phenylmercaptotetrazoles, thiouracils as disclosed in Japanese Patent Application No. 72992/74, for example, 2-thiouracils represented by the following formula;

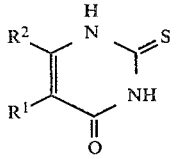

wherein $R^1$ represents a hydrogen atom, a hydroxyl group, an alkoxy group, a halogen atom, lower unsubstituted or substituted alkyl groups, a benzyl group, an aryl group, an amino group, a nitro group or a nitroso group, and $R^2$ represents a hydrogen atom, a hydroxyl group, a halogen atom, an amino group, an acetoamide group, an unsubstituted or substituted alkyl group containing from 1 to 22 carbon atoms, a phenyl group or a substituted aryl group, peroxides and persulfates as disclosed in Japanese Patent Application No. 5453/74, dissufides as disclosed in Japanese Patent Application No. 115781/74, palladium-containing compounds as disclosed in Japanese Patent Application No. 125037/74, such as palladium-acetylacetone complex salt, and so on.

Particularly preferred antifoggants used together with component (d) of the present invention are thiosulfonic acids, diterepenic acids, long chain aliphatic carboxylic acids, benzotriazoles and sulfinic acids.

It is preferred to add a compound capable of preventing the color change by light from occurring in the processed light sensitive material to the thermally developable light sensitive materials, where the color change by light means the phenomenon that unexposed areas of the processed light sensitive material gradually color when allowed to stand in a bright room. Specific examples of effective compounds for this purpose include precursors of stabilizing agents such as azole thioethers and blocked azole thiones, as disclosed in U.S. Pat. No. 3,839,041; tetrazolylthio compounds as disclosed in U.S. Pat. No. 3,700,457; and light sensitive halogen-containing organic oxidants as disclosed in U.S. Pat. No. 3,707,377. In addition, sulfur is favourable for the prevention of the color change by light.

It is possible to further stabilize the processed light sensitive material to light and heat. As examples of methods effective for such stabilization, mention may be made of stabilizing the processed sensitive material by applying a mercapto compound-containing solution as disclosed in U.S. Pat. No. 3,617,289; providing a laminate containing a stabilizer on or in the light sensitive material, as disclosed in Japanese Patent Application 102337/73; stabilizing with aldehyde compounds; stabilizing or fixing using a thiocyanate, thiosulfate or triphenyl phosphine; and treating the processed sensitive material with benzotriazole, phenylmercaptotetrazole, trichloromelamine, potassium iodide or a solvent such as trichlene, ethanol, acetone, isopropanol or the like.

Adding acids or certain N-halogeno compounds to the thermally developable light sensitive materials makes it possible to stabilize the light sensitive materials to light before the application of heat, and preheating prior to imagewise exposure can be used to render them light sensitive, as disclosed in U.S. Pat. Nos. 3,764,329; 3,802,888 and 3,816,132; and Japanese Patent Applications (Laid-Open) Nos. 89720/73, 10039/74 and 91214/74. Further, sensitivity and contrast can be altered by heating prior to the image-wise exposure, as disclosed in, for example, Japanese Patent Application (Laid-Open) No. 43630/73.

The thermally developable light sensitive materials of the present invention can contain an antistatic layer or a conductive layer, if desired. Halogenides, water soluble salts such as nitrates, ionic polymers as disclosed in U.S. Pat. Nos. 2,861,056 and 3,206,312; or insoluble inorganic salts as disclosed in U.S. Pat. No. 3,428,451 can be additionally incorporated in these layers. Furthermore, a thin metallic layer prepared by evaporation may be present.

In the thermally developable light sensitive material employed in the practice of the present invention, antihalation substances or antihalation dyes can be optionally incorporated. Heat decolorizable dyes are preferred as antihalation agents. For example, such dyes as are disclosed in U.S. Pat. Nos. 3,769,019 and 3,745,009; and Japanese Patent Publication No. 43321/74 are preferably used in the present invention. In addition, the thermally developable light sensitive materials of the present invention can contain filter dyes and light-absorbing substances as disclosed in, for example, U.S. Pat. Nos. 3,253,921; 2,527,583; 2,956,879 and 2,274,782. The thermally developable light sensitive materials of the present invention can optionally contain matting agents such as calcium carbonate, starch, titanium dioxide, zinc oxide, silica, dextrin, barium sulfate, alumina, kaolin, clay, diatomaceous earth and so on.

Fluorescent whiteness-increasing agents such as stilbenes, triazones, oxazoles, coumarin and so on as disclosed in, for example, German Pat. Nos. 972,067 and 1,150,274; French Pat. No. 1,530,244; and U.S. Pat. Nos. 2,933,390 and 3,406,070 may also be used in the present invention. These fluorescent whiteness-increasing agents are used as an aqueous solution or a dispersion.

The thermally developable light sensitive materials of the present invention can further contain plasticizers and lubricants. As examples of preferred plasticizers or lubricants, mention may be made of glycerin, diols, polyhydric alcohols as disclosed in, for example, U.S. Pat. No. 2,960,404; fatty acids and esters thereof as disclosed in, for example, U.S. Pat. Nos. 2,588,765 and 3,121,060; and silicone resins as disclosed in, for example, British Pat. No. 955,061. Surface active agents, for example, saponin and alkyl aryl sulfonates as disclosed in, for example, U.S. Pat. No. 2,600,831; amphoteric compounds as disclosed in, for example, U.S. Pat. No. 3,133,816; and glycidol-alkylphenol adducts and alkoxyphenol series surface active agents as disclosed in, for example, British Pat. No. 1,022,878 can also be incorporated into the thermally developable light sensitive materials of the present invention.

Certain layers of the thermally developable light sensitive elements, for example, a light-sensitive layer, which undergo a hardening treatment, can be hardened using various organic and inorganic hardeners in the practice of the present invention. Hardening agents can be used either singly or in combination. Preferred examples of hardeners include aldehydes, blocked aldehydes, ketones, carboxylic acids and carbonate derivatives, sulfonate esters, sulfonyl halides, vinylsulfonyl esters, active halogeno compounds, epoxy compounds, aziridenes, active olefins, isocyanates, carbodiimides, polymeric hardeners such as dialdehyde starchs, and so on.

Further, various additives can be added to increase image density. For example, compounds containing —CO—, —SO— or —$SO_2$— groups as disclosed in, for example, U.S. Pat. No. 3,667,959; and non-aqueous organic polar solvents such as tetrahydrothiophene-1,1-dioxide, 4-hydroxybutanonic lactone and methylsulfinyl methane are suitable for this purpose. Besides these, acetates of zinc, cadmium and copper as disclosed in U.S. Pat. No. 3,708,304 are effective.

Further, compounds which change into alkaline compounds on heating such as the compounds containing water of crystallization as disclosed in U.S. Pat. Nos. 3,635,719 and 3,531,285; guanidinium salts, acidic salts of amines and metal oxides or hydroxides are effective for accelerating development. For the purpose of increasing the developing speed, moisture-releasing agents can be optionally added. Moisture-releasing agents include not only the above-described compounds containing water of crystallization and metal hydroxides, but also ureas, caprolactam, p-nitroethanol, β-cyanoethanol, glycol, polyethylene glycol, glycerol, sorbitol, and mono- or oligosaccharides.

Besides the above-described additives, the combination of a polyalkylene glycol and mercaptotetrazole can also be employed to improve sensitivity, contrast and image density. Moreover, leuco dye compounds as disclosed in Japanese Patent Application No. 110287/73 can be employed a further improve the green shelf life.

Further, it is possible to increase the whiteness by blueing by the addition of blue dyes such as Victoria Blue to result in an improvement of the residual color produced by the dyes.

In the thermally developable light sensitive materials of the present invention, a subbing layer may be provided between the support and the heat developable light sensitive layer(s) coated on the support.

Polymer acids containing a behenic acid unit, a palmitic acid unit, a lauric acid unit, a rosin unit, a diterpenic acid unit, a polyacrylic acid unit, a maleic acid unit or an acrylic acid unit, benzotriazoles, mercaptoazoles, metal salts of fatty acids such as lithium laurate, lithium behenate, etc., and so on can be incorporated into the subbing layer to improve photographic characteristics such as the color change by light and thermal fog. Further, it is possible to prevent the emulsion from permeating into the support and to increase resolution by incorporating matting agents such as clay, kaolin, starch, barium sulfate, alumina, silica, titanium dioxide, zinc oxide and the like into the subbing layer. Also, a conductive metal layer produced by an electrolytic process may be used as a subbing layer.

Moreover, a polymer layer is preferably provided on the back side of a paper support to increase moisture resistance, to protect the support from curling, to facilitate note making and to prevent color toning agents or sublimating compounds from transfering from emulsion layers or the like. Polymers employed for the back layer include gelatin, polyvinyl alcohol, polyvinyl pyrrolidone, cellulose acetate butyrate, acrylate copolymers, polyamide resins, coumaronindene resins, cellulose diacetate, ethyl cellulose, the above-described polymers employed for the subbing layer and binders for emulsions as described hereinafter. This back polymer layer can additionally contain the above-described color toning agent and reducing agents, dyes and other additives. Further, thermally developable light sensitive materials which have a back layer containing a heat transferable dye can be employed as a thermal transfer material. As to these thermal transfer materials, descriptions are given in patents such as U.S. Pat. No. 3,767,394 and Japanese Patent Application (Laid-Open) No. 103639/74.

A polymer final coat can optionally be provided on a light sensitive layer to increase the transparency of a thermally developable light sensitive layer, increase image density, and improve upon the green shelf life, as disclosed in Japanese Patent Applications (Laid-Open) No. 6917/74 and 128726/74, Japanese Patent Application No. 97050/73, Belgian Pat. No. 798,367; and U.S. Pat. Nos. 3,856,526 and 3,856,527. A polymer final layer coated in a thickness ranging from about 1 micron to about 20 microns is most suitable for use. Suitable polymers for the polymer layer include polyvinyl chloride, polyvinyl acetate, vinyl chloride-vinyl acetate copolymers, polystyrene, polymethylmethacrylate, methylcellulose, ethylcellulose, cellulose acetate butyrate, cellulose acetate, polyvinylidene chloride, cellulose propionate, cellulose acetate phthalate, polycarbonate, cellulose acetate propionate, polyvinyl pyrrolidone, polyvinyl toluene, nitrocellulose, styrene-isobutylene copolymers, gelatin, a polymer latex, e.g., 2-acetoacetoxyethylmethacrylate, and carboxy-polyesters.

It is possible to make notes with stamp-ink, cinnabar seal ink, ballpoint ink or a pencil on a polymer final coat by incorporating therein a carrier such as titanium dioxide, kaolin, zinc oxide, silica, alumina, polysaccharides such as starch, and the like. In addition, the polymer final coat can contain antihalation dyes, filter dyes, ultraviolet ray absorbing agents, acid stabilizers such as higher fatty acids and color toning agents such as phthalazinone.

Each component employed in the present invention is preferably dispersed into at least one colloid which can be used as a binder. Most well-suited binders are, in general, hydrophobic ones, but hydrophilic binders may also be used. These binders are transparent or translucent, and include, for example, gelatin, proteins such as gelatin derivatives, cellulose derivatives, polysaccharides such as dextran, natural substances such as gum arabic, latex-like vinyl compounds of the kind which increase the dimensional stability of the materials and synthetic polymers as hereinafter described. Suitable synthetic polymers are disclosed in U.S. Pat. Nos. 3,142,586; 3,193,386; 3,062,674; 3,220,844; 3,287,289 and 3,411,911. Effective polymers include water-insoluble polymers containing as a monomer unit alkyl acrylates, alkyl methacrylates, acrylic acid, sulfoalkyl acrylates, sulfoalkyl methacrylates or the like, and polymers containing a repeating sulfobetaine unit as disclosed in Canadian Pat. No. 774,054. Additonal suitable macromolecular compounds and resins for use as a binder include polyvinyl butyral, polyacrylamide, cellulose acetate butyrate, cellulose acetate propionate, polymethylmethacrylate, polyvinyl pyrrolidone, polystyrene, ethylcellulose, polyvinyl chloride, chlorinated rubber, polyisobutylene, butadiene-styrene copolymers, vinyl chloride-vinyl acetate copolymers, vinyl chloride-vinyl acetate-maleic acid terpolymers, polyvinyl alcohol, polyvinyl acetate, benzyl cellulose, cellulose acetate, cellulose propionate, cellulose acetate phthalate, polyvinyl formal, polyvinyl pyridine, polyvinylidene chloride, methyl vinyl ether-maleic anhydride copolymers, polyvinyl acrylamide, cellulose nitrate, butylcellulose, carboxymethylcellulose, hydroxyethylcellulose, nitrocellulose, polyethylene, polyethylene glycol, polyethylene oxide, polyacrylates, polysulfoalkylacrylates, polysulfoalkylmethacrylates, polyamides, terpene resins, alginic acid and the derivatives thereof, onium halide series conductive polymers and phenol resins. Of these polymers, particularly preferred polymers are polyvinyl butyral, polyvinyl acetate, ethylcellulose, polymethylmethacrylate, cellulose acetate butyrate, gelatin and polyvinyl alcohol. These polymers may be used in combination, if desired. A preferred weight ratio of the amount of the binder to that of component (a), the organic silver salt(s), ranges from about 10:1 to about 1:10, particularly preferably about 4:1 to 1:4.

A lithographic plate can also be made by using a special binder as disclosed in Japanese Patent Application (Laid-Open) No. 4659/72 and U.S. Pat. No. 3,679,414. Also, a lithographic plate can be made by taking advantage of a special layer structure as is disclosed in U.S. Pat. No. 3,811,886.

Further, the method disclosed in U.S. Pat. No. 3,767,394 and Japanese Patent Application (Laid-Open) No. 103639/74 applied to the present light sensitive system enables the system to be employed as a thermal transfer sheet.

Layers containing each of the components employed in the thermally developable light sensitive materials of the present invention, and other layers, may be coated on a support selected from a wide variety of materials. These supports may have any shape. However, film-, sheet-, roll- and ribbon-like shapes, commonly preferred as flexible supports, are advantageous on handling as an information recording material.

Materials useful as the support include plastic film, sheet, glass, wool, cotton, cloth, paper and metals such as aluminum. As plastic films, cellulose acetate film, polyester films, e.g., polyethylene terephthalate film, polyamide film, polyimide film, triacetate film, polycarbonate film, orientated polyethylene telephthalate film, cellulose nitrate film, cellulose ester film, polyvinyl acetal film, polystyrene film, polyethylene terephthalate film colored by titanium dioxide or the like, heat decolorizable dye-containing films, polyester films having a hydrophilic surface prepared by dispersing silica or the like and a partially hydrolyzed vinyl chloride-vinyl acetate copolymer, and polyethylene terephthalate film on which a gelatin subbing layer is provided can be employed. Examples of paper supports include not only generally used paper, but also photographic raw paper, printing paper such as coated paper and art paper, baryta paper, resin-coated paper, water-proof paper, paper having received a sizing treatment using a polysaccharide or the like as disclosed in Belgian Pat. No. 784,615; partially acetylated paper, pigmented paper containing titanium dioxide or the like, α-olefin polymer (e.g., polyethylene, polypropylene, ethylene-butene copolymers, etc.) coated paper, paper having received a preliminary treatment with polyvinyl alcohol or a metallic thin film, film or paper endowed with conductivity by having received a carbon treatment, gelatin undercoated paper, glassine paper, kent paper, map overlay coated paper, paper having a surface made up of clay, insolubilized casein or carboxymethylcellulose, paper having received a calendering treatment, paper impregnated with or coated by acidic polymers, and so on.

Besides the above, an aluminium plate under-coated with polyacrylamide, an aluminium plate having received a treatment with a hydrophilic silicate, and a support containing as a subbing layer a conductive metal layer can be also used.

Patterns can be optionally engraved on either the upper layer or the back layer of the support. Engraving of this kind is required for making a post card or a commutation ticket.

The above-described various kinds of layers are generally provided on one of the aforesaid supports, but some components can be incorporated into the support itself. Incorporation of some components into a support such as a plastic film, glass or metal film is, of course, accompanied with many dificulties in permitting the components to efficiently exert their intended effect. However, the incorporation of some components into a paper support permits the components to exert their effect to the same extent as the incorporation of them into any layer provided on a support.

An anti-foggant, a toning-agent and an anti-halation-agent are examples of materials which may be incorporated into the support. In the present invention, an organic silver salt, a photocatalyst and, optionally, a sensitizing dye can be incorporated in the same layer (i.e., this layer is called a photosensitive layer) if desired).

Other ingredients of the present invention (such as a reducing agent, a toning agent, an anti-fogging agent and an ultraviolet absorbing agent, etc.) can be incorporated in the above photosensitive layer, or another layer on the support such as the subbing layer or a protective layer, if desired.

In the present invention, it is most preferred to incorporate an organic silver salt, a photocatalyst, a reducing agent, a toning agent, an antifoggant and a binder in one layer on the support.

The light sensitive composition is coated on a support at the coverage ranging from about 0.2 g to about 3 g, preferably from about 0.3 g to about 2 g, in terms of silver content in both the organic silver salt and the silver halide, per square meter of support. When the coating amount is less than the aforesaid lower limit, the maximum density of the resulting image becomes too low, while there is a tendency for the maximum density of the image to be saturated in the range more than the upper limit. Therefore, an excess amount of coating over the aforesaid upper limit increases the cost of the product.

One preparation method for thermally developable light sensitive materials which can be employed in the present invention is roughly illustrated below. Namely, the organic silver salt-forming agent is allowed to react with a silver ion-donating agent (e.g., silver nitrate) according to one of the previously-described various methods to result in the production of the organic silver salt. It is preferred to add component (d) in the course of or prior to the organic silver salt-producing process. The preparation procedure is usually carried out at atmospheric pressure and at an appropriate temperature ranging from −50° C. to +80° C., particularly from about 20° C. to about 60° C. The resulting organic silver salt is washed with water, an alcohol or the like, and then dispersed into a binder for emulsion formation by means of a colloid mill, a mixer, a ball mill or the like. The dispersion is usually carried out at ordinary temperature (15° C. to 25° C.). A silver halide-forming agent is then added to the thus obtained polymer dispersion of the silver salt to convert some portion of the organic silver salt into the corresponding silver halide. An approximate reaction temperature is in the range of ordinary temperature to 80° C., and a proper reaction time can be arbitrarily chosen in the range of from about 1 minute to about 48 hours. As earlier described, a previously prepared silver halide may be added to the aforesaid dispersion, or an organic silver salt and silver halide can be produced at the same time. It is preferred to add component (d) in the course of or prior to the silver salt-forming process. Various additives such as sensitizing dyes, reducing agents, color toning agents and so on are then added, preferably in the form of a solution, in the order of description. At this time, component (d) may be also added. Usually, the components are added in turn with stirring at a temperature ranging from ordinary temperature to 50° C. at an appropriate time interval (usually 5 to 20 minutes). The thus prepared coating solution is coated on a proper support without drying. In order to provide a final coat polymer layer, a subbing layer, a back layer and other layers, the respective coating solutions are prepared in a manner similar to the above, and are coated in turn by dipping, air-knife coating, curtain coating or hopper coating. Two or more layers may be optionally coated simultanously according to a method as disclosed in U.S. Pat. No. 2,761,791 and British Pat. No. 837,095.

If desired, printing can be carried out on the surface or the back of the support, or a layer provided on the support, to produce a commuter or like ticket, a post card or other writings.

The thus prepared heat developable light sensitive material is cut to an appropriate size, if necessary, and then subjected to image-wise exposure. The resulting material can be optionally pre-heated (up to 80° C. to 140° C.) before the image-wise exposure. Light sources well-suited for the imagewise exposure include a tungsten lamp, a fluorescent lamp for copying which is chiefly employed for the exposure of diazo light sensitive materials, a mercury lamp, a xenon lamp, a CRT light source, a laser and so on. As an original, not only an a line image such as a drafting be used but also photographic images with gradation, portraits and scenic images taken with a camera can be used.

The printing techniques applicable to the present invention include contact printing wherein the original is closely superposed on the sensitive material, reflection printing and enlargement printing. The exposure amount depends upon the sensitivity of the sensitive material obtained. As a guide, about a 10 lux·second exposure amount is required for high sensitivity materials, while about a $10^4$ lux·second exposure amount is required for low sensitivity materials.

The thus image-wise exposed sensitive material can be developed merely by heating (up to about 80° C. to about 180° C., preferably up to about 100° C. to about 150° C.). The heating duration for developing is arbitrarily controlled in the range of 1 to 60 seconds. It depends upon the heating temperature. Usually, about 5 to 40 seconds heating is required at 120° C., about 2 to about 20 seconds heating is required at 130° C., and about 1 to about 10 seconds heating is required at 140° C.

A wide variety of means can be used for heating the sensitive material. For example, the sensitive material may be allowed to come into contact with a simple heated plate or with a heated drum. According to circumstances, the sensitive material may be allowed to pass through a heated space. In addition, it may be heated by using high frequency waves or a laser beam. The odor generated on heating can be masked by using a processing machine equipped with a deodorant. Perfumes can be incorporated in the sensitive material so as to mask the odor generated from the sensitive material on heating, as disclosed in Japanese Patent Application No. 82518/74.

The thermally developable light sensitive materials prepared in the present invention have, in general, the character of easily undergoing deterioration when they are in contact with moisutre. Therefore, it is desirable that the finished sensitive materials be packed together with a desicant when shipped as a commodity, as disclosed in Japanese Patent Application (Laid-Open) No. 2523/75.

In accordance with a preferred embodiment of the present invention, thermally developable light sensitive materials of excellent green shelf life exhibiting a high degree of whiteness and high sensitivity are provided.

The present invention will now be illustrated in greater detail by the following examples.

EXAMPLE 1

1.9 g of sodium hydroxide was dissolved in 100 ml of water. This water solution was mixed with a solution prepared by dissolving 12 g of lauric acid into 100 ml of toluene to form an emulsion (at 25° C.). An aqueous solution of 8.5 g of silver nitrate dissolved in 50 ml of water and an aqueous solution of 0.3 g of $(NH_4)_2Ce(NO_3)_6$ dissolved in 25 ml of water were simultaneously added to the emulsion at 21° C. The addition rate of both solutions was adjusted so as to be the same. At the conclusion of dropwise addition of the aqueous solution of silver nitrate, the emulsion separated into an aqueous phase and a toluene phase containing silver laurate. After removal of the aqueous phase, precipitates (cerium ion-containing silver laurate) were collected from the toluene phase by centrifuging.

The precipitate was dispersed into a polymer solution, which was produced by adding 23.5 g of polyvinyl butyral (polymerization value 1000) to 160 ml of isopropanol, by means of a homogenizer to prepare a polymer dispersion of the silver salt (wherein about 1/20 mole of silver laurate was contained). An 80 g portion of the polymer dispersion of the silver salt was kept at 50° C., and 16 cc of 1.1 wt.% of an N-bromoacetamide solution in acetone was added thereto with stirring, and the reaction system allowed to stand for 60 minutes while heating was continued to maintain it at 50° C.

After chill-setting the resultant despersion at 30° C., the following components were added in their order of description every 5 minutes to the resultant dispersion as the stirring was continued.

| COMPONENTS | |
|---|---|
| (a) Sensitizing Dye (merocyanine dye having the following formula) 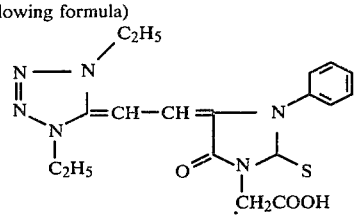 | |
| (0.025 wt % 2-methoxyethanol solution) | 10 ml |
| [Other merocyanine dyes, other cyanine dyes and acidic dyes instead of this dye can be used in a similar manner.] | |
| (b) Antifoggant<br>Sodium thiobenzene sulfonate<br>(0.02 wt % methanol solution) | 24 ml |
| (c) Antifoggant<br>Rosin (oxidation value 162; Staybelite Rosin, produced by Hercules Powder, Inc.)<br>(10 wt % ethanol solution) | 8 ml |
| (d) Antifoggant<br>Benzotriazole<br>(0.15 wt % methanol solution) | 12 ml |
| (e) Color Toning Agent<br>Phthalazone<br>(3 wt % methanol solution) | 32 ml |
| (f) Reducing Agent 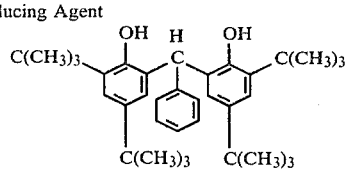 | |
| (24 wt % acetone solution) | 40 ml |

The thus prepared coating dispersion was coated on art paper at a coverage of 0.4 g of silver per square meter. Thermally developable light sensitive material A was thus obtained.

For purposes of comparison, thermally developable light sensitive material B was prepared in the same manner as the sensitive material A except that the addition of $(NH_4)_2Ce(NO_3)_6$ was omitted.

The thus produced heat developable light sensitive materials A and B were each exposed to tungsten light through a wedge ($3\times10^3$ lux.sec.) and developed by heating at 140° C. for 8 seconds. They were then subjected to sensitometry. Idential samples of thermally developable light sensitive materials A and B were allowed to stand for 7 days at 35° C. in an atmosphere containing moisture at a relative humidity of 80% and then subjected to sensitometry as above. The results are shown in Table 1.

TABLE 1

| | | Sensitive Material A | Sensitive Material B |
|---|---|---|---|
| Fresh | Sensitivity* | 103 | 100 |
| | Fog | 0.17 | 0.18 |
| | Dmax | 1.45 | 1.41 |
| 35° C., 80% After 7 Days | Sensitivity* | 107 | 120 |
| | Fog | 0.20 | 0.80 |
| | Dmax | 1.35 | 1.33 |

*The reciprocal of the exposure amount required to provide a density of fog + 0.1, and the relative value obtained when the sensitivity of sensitive material B is set as 100.

As is apparent from the results in Table 1, sensitive material A of the present invention had an excellent green shelf life.

EXAMPLE 2

Thermally developable light sensitive material C was prepared in the same manner as sensitive material A in Example 1 except that 0.2 g of $Ce(SO_4)_2$ was added instead of $(NH_4)_2Ce(NO_3)_6$. Development and sensitometory were carried out under the same conditions as in Example 1. The results are shown in Table 2.

TABLE 2

| Sensitive Material | | C | B (Comparison) |
|---|---|---|---|
| Fresh | Sensitivity | 95 | 100 |
| | Fog | 0.18 | 0.18 |
| | Dmax | 1.35 | 1.41 |
| 35° C., 80% After 7 Days | Sensitivity | 99 | 120 |
| | Fog | 0.25 | 0.80 |
| | Dmax | 1.30 | 1.33 |

As is apparent from the results shown in Table 2, sensitive material C of the present invention had an excellent green shelf life.

EXAMPLE 3

Thermally developable light sensitive material D was prepared in the same manner as sensitive material A in Example 1 except that 24 mg of $CeBr_3.5H_2O$ was added instead of $(NH_4)_2Ce(NO_3)_6$. Sensitive material B (for comparison) and sensitive material D were each developed and subjected to sensitometry under the same conditions as in Example 1.

Developed materials B and D were each exposed to a fluorescent lamp (10,000 lux, 10 hours) over the whole surface thereof. Then, the increase in background density (image-free areas) was examined. With respect to the degree of whiteness after overall exposure, sensitive material D was more excellent than sensitive material B.

TABLE 3

| Sensitive Material | D | B (Comparison) |
|---|---|---|
| Sensitivity* | 330 | 100 |
| Fog | 0.14 | 0.18 |
| Dmax | 1.13 | 1.14 |
| ΔD** | 0.05 | 0.15 |

*The relative value obtained when the sensitivity of sensitive material B is set as 100.
**The value obtained by subtracting the fog value observed just after heat development was completed from the fog value observed after the overall exposure to a fluorescent lamp.

As is apparent from the results in Table 3, sensitive material D shows a more improved sensitivity and color change by light.

EXAMPLE 4

Thermally developable light sensitive material E was prepared in the same manner as sensitive material A in Example 1 except that 20 mg of $Ce(NO_3)_3.6H_2O$ was added instead of $(NH_4)_2Ce(NO_3)_6$. Sensitive material B (employed for comparison) and the sensitive material E were compared following processing as in Example 3 and under the same conditions as in Example 3.

Regarding the degree of whiteness after the overall exposure, sensitive material E was more excellent. The results of testing are shown in Table 4.

TABLE 4

| Sensitive Material | E | B (Comparison) |
|---|---|---|
| Sensitivity | 280 | 100 |
| Fog | 0.15 | 0.18 |
| Dmax | 1.15 | 1.41 |
| ΔD | 0.07 | 0.15 |

As is apparent from the results in Table 4, sensitive material E has improved sensitivity and color change by light.

EXAMPLE 5

Thermally developable light sensitive material F was prepared in the same manner as sensitive material A in Example 1 except that 12 g of stearic acid was used instead of lauric acid, 20 ml of a 20 wt% acetone solution of the reducing agent having the following formula

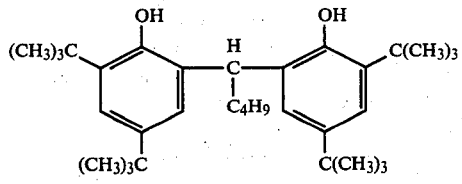

was added instead of reducing agent (f) having the following formula

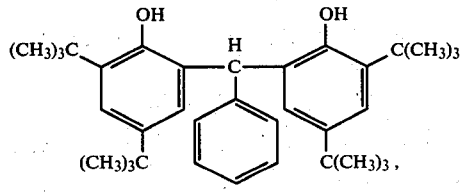

and stencil paper for a pressure sensitive sheet on which polyvinyl alcohol was under-coated was used instead of art paper.

For the purpose of comparison, thermally developable light sensitive material G was prepared in the same manner as sensitive material F except that $(NH_4)_2Ce(NO_3)_6$ was not added.

Each of the sensitive materials F and G was subjected to development and subjected to sensitometry under the same conditions as in Example 1. The results are shown in Table 5.

TABLE 5

| Sensitive Material | | F | G |
|---|---|---|---|
| Fresh | Sensitivity | 103 | 100 |
| | Fog | 0.17 | 0.20 |
| | Dmax | 1.30 | 1.25 |
| 35° C., 80% After 7 Days | Sensitivity | 100 | 95 |
| | Fog | 0.23 | 0.75 |
| | Dmax | 1.27 | 1.20 |

As is apparent from the results shown in Table 5, sensitive material F of the present invention had an excellent green shelf life.

EXAMPLE 6

Thermally developable light sensitive material H was prepared in the same manner as sensitive material B except that a solution prepared by dissolving 10 mg of $CeBr_3.5H_2O$ in 10 ml of methanol was added prior to the addition of N-bromoamide.

Sensitive material B (employed for comparison) and sensitive material H were exposed, developed and tested as in Example 3. The results are shown in Table 6.

TABLE 6

| Sensitive Material | H | B (Comparison) |
|---|---|---|
| Sensitivity | 230 | 100 |
| Fog | 0.15 | 0.18 |
| Dmax | 1.20 | 1.41 |
| ΔD | 0.08 | 0.15 |

With respect to the degree of whiteness after overall exposure, sensitive material H was more excellent.

EXAMPLE 7

Thermally developable light sensitive material I was prepared in the same manner as sensitive material H in Example 6 except that 10 mg of $Ce(CH_3COCHCOCH_3)_3$ was added instead of $CeBr_3.5H_2O$.

The results obtained after processing and testing as in Example 3 are shown in Table 7.

TABLE 7

| Sensitive Material | I | B (Comparison) |
|---|---|---|
| Sensitivity | 195 | 100 |
| Fog | 0.17 | 0.18 |
| Dmax | 1.25 | 1.41 |
| ΔD | 0.08 | 0.15 |

Sensitive material I is seen to be more excellent in the degree of whiteness after overall exposure.

EXAMPLE 8

Thermally developable light sensitive material J was prepared in the same manner as sensitive material B in Example 1 except that a solution of 0.1 g of $(NH_4)_2Ce(NO_3)_6$ in 15 ml of methanol was added before the addition of color toning agent (e) (phthalazone).

The results obtained after processing and testing as in Example 1 are shown in Table 8.

TABLE 8

| Sensitive Material | | C | B (Comparison) |
|---|---|---|---|
| Fresh | Sensitivity | 98 | 100 |
| | Fog | 0.18 | 0.18 |
| | Dmax | 1.35 | 1.41 |
| 35° C., 80% After 7 Days | Sensitivity | 103 | 120 |
| | Fog | 0.45 | 0.80 |
| | Dmax | 1.30 | 1.33 |

According to the above, it is apparent that fog due to storage under high temperature and high humidity conditions can be prevented by the use of ammonium ceric nitrate.

Furthermore, from Table 1 and Table 8, it is apparent that the fog preventing effect was advantageous when ammonium ceric nitrate was used in the formation of the silver laurate.

While the invention has been described in detail and with reference to specific embodiments thereof, it will be apparent to one skilled in the art that various changes and modifications can be made therein without departing from the spirit and scope thereof.

What is claimed is:

1. A heat developable image-forming light sensitive material which comprises; (a) an organic silver salt; (b) a photocatalyst and (c) a reducing agent in a support or in at least one layer provided on a support, said support or at least one layer of said layers further containing (d) at least one cerium compound selected from the group consisting of trivalent and tetravalent cerium compounds.

2. The material of claim 1 wherein said trivalent or tetravalent cerium compounds are represented by the following general formulae (I) or (II):

$$Ce_lX_m.xH_2O \quad (I)$$

$$M_nCe_pX_q.yH_2O \quad (II)$$

wherein cerepresents a trivalent or tetravalent cerium atom; X represents an anion or group capable of conversion into an ion; l, m, n, p and q represent integers necessary to render the compound neutral, x and y each represents an integer of 0 to 16 and M represents a cation or group capable of being converted into a cation.

3. The material of claim 2 wherein said anion or group capable of conversion into an anion is selected from a nitrate ion, an oxygen ion, a titanate ion, an acetate ion, an acetyl acetonate ion, a carbonate ion, a halogen ion, a long chain aliphatic carboxylic group, a perchlorate ion or a phosphorate ion.

4. The material of claim 3 wherein M is a hydrogen ion, an alkali metal ion or an onium group.

5. The material of claim 3 wherein said trivalent or tetravalent cerium compounds are selected from the group consisting of: $Ce(OH)_3$, $Ce(OH)_4$, $CeO_2$, $Ce_2O_3$, $Li_8CeO_6$, $Na_2CeO_3$, $KCeO_2$, $K_2CeO_3$, CeN, $Ce(NO_3)_3$, $Ce(NO_3)_3.6H_2O$, $Ce(NO_3)_3.5H_2O$, $Ce(NO_3)_3.4H_2O$, $Ce(NO_3)_4.5H_2O$, $CeOH(NO_3)_3.xH_2O$ (x=0 or 3), $KCe(NO_3)_4.H_2O$, $K_2Ce(NO_3)_5$, $K_2Ce(NO_3)_6$, $RbCe(NO_3)_4.H_2O$ $Rb_2Ce(NO_3)_5.4H_2O$, $Rb_2Ce(NO_3)_6$, CsCe(-

$NO_3)_5.H_2O$, $(NH_4)_2Ce(NO_3)_6$ $NH_4HCe(NO_3)_5.H_2O$, $(NH_4)_2Ce(NO_3)_5.xH_2O$ (x=0 or 4), $Ce(CH_3COO)_3.H_2O$, $(CH_3COCHCOCH_3)_3Ce$, $(NH_4)_2Ce(SO_4)_6.xH_2O$, (x=0,2 and/or 8), $Ce_2(CO_3)_3.8H_2O$, $CeCl_3.7H_2O$, $Ce_2(SO_4)_3.8H_2O$, $Ce(SO_4)_2.xH_2O$ (x=0, 2, 4, 5, 8, 9 or 12), $CeBr_3$, $CeBr_3$, $Ce(TiO)_3)_2$, $CeI_3.9H_2O$, $Ce(ClO_4)_3.6H_2O$, $CePO_4$, $Ce(C_{12}H_{25}COO)_3$, $Ce(C_{22}H_{45}COO)_3$ and $Ce(C_{18}H_{37}COO)_3$, wherein x is from 0 to 10.

6. The material of claim 1, wherein said trivalent or tetravalent cerium compound is a cerium complex salt containing as a ligand a member selected from a nitrogen containing organic compound or a dibasic acid.

7. The material of claim 6 wherein the cerium complex salt is selected from the group consisting of: $Ce(Dip)_2(NO_3)_3.xH_2O$ (where Dip is 2,2'-bipyridyl), (x=0 to 16), $Ce(Dip)_2Br_3$, $Ce(Phen)_2(NO_3)_3$ (where Phen is phenanthroline), $Ce(Phen)_2(SCN)_3$, Ce(Phtha)Br (where Phtha is phthalocyanine), $Ce(Uro)_2(SCN)_3.8H_2O$ (where Uro is urotropin), $Na_3[Ce(DP)_3]$ (where DP is diphenic acid), $Na[Ce(Naphth)_2]$ (where Naphth is naphthalic acid) and $NH_4[Ce(OX)_2].xH_2O$ (where OX is oxalic acid), (x=0 to 16).

8. The material of claim 1 wherein about $5\times10^{-1}$ mol to about $1\times10^{-5}$ mol of component (d) is present per mol of organic silver salt (a).

9. The material of claim 5 wherein about $10^{-1}$ to about $10^{-4}$ mol of component (d) is present per mol of organic silver salt (a).

10. The material of claim 6, wherein said ligand is selected from the group consisting of 2,2'-bipyridyl, 1,10-phenanthroline, phthalocyanine, pyridine, quinoline, 8-hydroxyquinoline, urotropin, diphenic acid, naphthalic acid, phthalic acid and oxalic acid.

11. The material of claim 1, wherein said organic silver salt is a silver salt of an imino, mercapto, thione or carboxyl group containing organic compound.

12. The material of claim 1, wherein said organic silver salt is a silver salt of a long chain aliphatic acid.

13. The material of claim 1, wherein said photocatalyst is a light-sensitive silver halide or a component capable of forming a light-sensitive silver silver halide.

14. The material of claim 13, wherein said silver halide is silver chloride, silver bromide, silver bromochloride, silver iodobromide, silver iodide or silver iodobromochloride.

15. The material of claim 13, wherein said component capable of forming a light-sensitive silver halide or reacting with the organic silver salt is an organic halide having the formula $MX_n$, wherein M represents a hydrogen atom, an ammonium group or a metal atom, X represented a halogen atom, and n is 1 when M is a hydrogen atom or an ammonium group, and n is the valence of the metal when M is a metal atom; a halogen-containing metal complex; an onium halide; a halogenated hydrocarbon; an N-halo compound having formula (I) or (II):

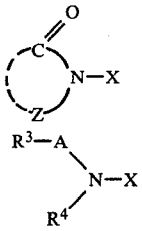

(I)

(II)

wherein X represents a halogen atom, Z represents an atomic group necessary to form a 5- to 7-membered ring, A represents a carbonyl group or a sulfonyl group, and $R^3$ and $R^4$ each represents an alkyl group, an aryl group, an alkoxy group, an N-halobenzotriazole, an N-halobenzotriazole substituted with one or more of an alkyl group, a nitro group, a halogen atom, an imido group, or an amino group, or N-bromobenzimidazole; or a halogen-containing compound selected from the group consisting of triphenylmethyl chloride, triphenylmethyl bromide, 2-bromobutyric acid, 2-bromoethanol and dichlorobenzophenone.

16. The material of claim 1, wherein said reducing agent is a substituted phenol, a substituted or unsubstituted bisphenol, a subsituted or unsubstituted mono- or bisnaphthol, a di- or polyhydroxybenzene, a di- or polyhydroxynaphthalene, a hydroquinone monoether, ascorbic acid or a derivative thereof, a 3-pyrazolidone, a 3-pyrazolin-5-one, a reducing saccharide, an aromatic primary amino compound, a reductone, kojic acid, hinokitiol, a hydroxylamine, a hydroxytetronic acid, a hydroxytetronic acid amide, a hydroxamic acid, a sulfohydroxamic acid, a hydrazide, an indan-1,3-dione, a p-oxyphenylglycine, an ester of a carboxylic acid derived from a phenol having a substituent in at least one ortho position and a mono- or polyhydric alcohol or phenol, or an ester of an alcohol derived from a polyhydric phenol having a substituent in at least one ortho position thereof or of a phenol substituted with a bulky substituent in at least one ortho position thereof and a mono- or polycarboxylic acid.

17. A heat developable image-forming light sensitive material which comprises (a) an organic silver salt; (b) a photocatalyst and (c) a reducing agent in a support or in at least one layer provided on a support, said support or least one layer of said layers further containing (d) at least one cerium compound selected from the group consisting of trivalent and tetravalent cerium compounds, wherein said trivalent or tetravalent cerium compounds are cerium complex salts or are represented by the following general formulae (I) or (II):

$$Ce_lX_m.xH_2O \quad (I)$$

$$M_nCe_pX_q.yH_2O \quad (II)$$

wherein Ce represents a trivalent or tetravelant cerium atom; X represents an anion or group capable of conversion into an anion; l, m, n, p and q represent integers necessary to render the compound neutral, x and y each represents an integer of 0 to 16 and M represents a cation or group capable of being converted into a cation.

* * * * *